US010465505B2

(12) United States Patent
Disko et al.

(10) Patent No.: US 10,465,505 B2
(45) Date of Patent: Nov. 5, 2019

(54) RESERVOIR FORMATION CHARACTERIZATION USING A DOWNHOLE WIRELESS NETWORK

(71) Applicants: Mark M. Disko, Glen Gardner, NJ (US); Limin Song, West Windsor, NJ (US)

(72) Inventors: Mark M. Disko, Glen Gardner, NJ (US); Limin Song, West Windsor, NJ (US)

(73) Assignee: ExxonMobil Upstream Research Company, Spring, TX (US)

( * ) Notice: Subject to any disclaimer, the term of this patent is extended or adjusted under 35 U.S.C. 154(b) by 31 days.

(21) Appl. No.: 15/666,312

(22) Filed: Aug. 1, 2017

(65) Prior Publication Data

US 2018/0058202 A1 Mar. 1, 2018

Related U.S. Application Data

(60) Provisional application No. 62/433,491, filed on Dec. 13, 2016, provisional application No. 62/428,367,
(Continued)

(51) Int. Cl.
*E21B 47/14* (2006.01)
*E21B 49/08* (2006.01)
(Continued)

(52) U.S. Cl.
CPC ..... *E21B 47/14* (2013.01); *E21B 49/087* (2013.01)

(58) Field of Classification Search
None
See application file for complete search history.

(56) References Cited

U.S. PATENT DOCUMENTS 3,103,643 A 9/1963 Kalbfell ..... 340/17
3,205,477 A 9/1965 Kalbfell ..... 340/18
(Continued)

FOREIGN PATENT DOCUMENTS

CN 102733799 6/2014 ..... E21B 47/16
EP 0636763 2/1995 ..... E21B 47/12
(Continued)

OTHER PUBLICATIONS

U.S. Appl. No. 15/666,334, filed Aug. 1, 2017, Walker, Katie M. et al.
(Continued)

*Primary Examiner* — Thomas S McCormack
(74) *Attorney, Agent, or Firm* — ExxonMobil Upsteam Research Company—Law Department

(57) ABSTRACT

A system for reservoir formation characterization with a downhole wireless telemetry system, including at least one sensor disposed along a tubular body; at least one sensor communications node placed along the tubular body and affixed to a wall of the tubular body, the sensor communications node being in communication with the at least one sensor and configured to receive signals therefrom; a topside communications node placed proximate a surface; a plurality of intermediate communications nodes spaced along the tubular body and attached to a wall of the tubular body, wherein the intermediate communications nodes are configured to transmit signals received from the at least one sensor communications node to the topside communications node in substantially a node-to-node arrangement; a receiver at the surface configured to receive signals from the topside communications node; and a topside data acquisition system structured and arranged to communicate with the topside communications node. A method for reservoir formation characterization is also provided.

48 Claims, 12 Drawing Sheets

Related U.S. Application Data filed on Nov. 30, 2016, provisional application No. 62/428,425, filed on Nov. 30, 2016, provisional application No. 62/428,374, filed on Nov. 30, 2016, provisional application No. 62/428,380, filed on Nov. 30, 2016, provisional application No. 62/381,335, filed on Aug. 30, 2016, provisional application No. 62/381,330, filed on Aug. 30, 2016.

(51) Int. Cl.
*E21B 47/01* (2012.01)
*E21B 47/12* (2012.01)

(56) References Cited

U.S. PATENT DOCUMENTS 3,512,407 A 5/1970 Zill ..... 73/152
3,637,010 A 1/1972 Malay et al. ..... 166/51
3,741,301 A 6/1973 Malay et al. ..... 166/191
3,781,783 A 12/1973 Tucker ..... 340/18
3,790,930 A 2/1974 Lamel et al. ..... 340/18
3,900,827 A 8/1975 Lamel et al. ..... 340/18
3,906,434 A 9/1975 Lamel et al. ..... 340/18
4,001,773 A 1/1977 Lamel et al. ..... 340/18
4,283,780 A 8/1981 Nardi ..... 367/82
4,298,970 A 11/1981 Shawhan et al. ..... 367/82
4,302,826 A 11/1981 Kent et al. ..... 367/82
4,314,365 A 2/1982 Peterson et al. ..... 367/82
4,884,071 A 11/1989 Howard ..... 340/854
4,962,489 A 10/1990 Medlin et al. ..... 367/32
5,128,901 A 7/1992 Drumheller ..... 367/82
5,136,613 A 8/1992 Dumestre, III ..... 375/1
5,166,908 A 11/1992 Montgomery ..... 367/165
5,182,946 A 2/1993 Boughner et al. ..... 73/151
5,234,055 A 8/1993 Cornette ..... 166/278
5,283,768 A 2/1994 Rorden ..... 367/83
5,373,481 A 12/1994 Orban et al. ..... 367/82
5,468,025 A 11/1995 Adinolfe et al. ..... 285/114
5,480,201 A 1/1996 Mercer ..... 294/67.31
5,495,230 A 2/1996 Lian ..... 340/551
5,562,240 A 10/1996 Campbell ..... 227/130
5,592,438 A 1/1997 Rorden et al. ..... 367/83
5,667,650 A 9/1997 Face et al. ..... 204/298.07
5,850,369 A 12/1998 Rorden et al. ..... 367/83
5,857,146 A 1/1999 Kido ..... 455/38.3
5,924,499 A 7/1999 Birchak et al. ..... 175/40
5,960,883 A 10/1999 Tubel et al. ..... 166/313
5,995,449 A 11/1999 Green et al. ..... 367/83
6,049,308 A 4/2000 Deflandre ..... 367/48
6,125,080 A 9/2000 Sonnenschein et al. ..... 367/134
6,128,250 A 10/2000 Reid et al. ..... 367/153
6,177,882 B1 1/2001 Ringgenberg et al. ..... 340/853.7
6,236,850 B1 5/2001 Desai ..... 455/343
6,239,690 B1 5/2001 Burbidge et al. ..... 340/10.33
6,300,743 B1 10/2001 Patino et al. ..... 320/106
6,320,820 B1 11/2001 Gardner et al. ..... 367/81
6,324,904 B1 12/2001 Ishikawa et al. ..... 73/152.03
6,360,769 B1 3/2002 Brisco ..... 137/268
6,394,184 B2 5/2002 Tolman et al. ..... 166/281
6,400,646 B1 6/2002 Shah et al. ..... 367/82
6,429,784 B1 8/2002 Beique et al. ..... 340/853.2
6,462,672 B1 10/2002 Besson ..... 340/853.2
6,543,538 B2 4/2003 Tolman et al. ..... 166/284
6,670,880 B1 12/2003 Hall et al. ..... 336/132
6,679,332 B2 1/2004 Vinegar et al. ..... 166/373
6,695,277 B1 2/2004 Gallis ..... 241/191
6,702,019 B2 3/2004 Dusterhoft et al. ..... 166/278
6,717,501 B2 4/2004 Hall et al. ..... 336/132
6,727,827 B1 4/2004 Edwards et al. ..... 340/854.9
6,772,837 B2 8/2004 Dusterhoft et al. ..... 166/278
6,816,082 B1 11/2004 Laborde ..... 340/853.3
6,868,037 B2 3/2005 Dasgupta et al. ..... 367/54
6,880,634 B2 4/2005 Gardner et al. ..... 166/250.01
6,883,608 B2 4/2005 Parlar et al. ..... 166/278
6,899,178 B2 5/2005 Tubel ..... 166/313
6,909,667 B2 6/2005 Shah et al. ..... 367/83
6,912,177 B2 6/2005 Smith ..... 367/82
6,920,085 B2 7/2005 Finke et al. ..... 367/83
6,930,616 B2 8/2005 Tang et al. ..... 340/854.4
6,940,392 B2 9/2005 Chan et al. ..... 340/10.4
6,940,420 B2 9/2005 Jenkins ..... 340/855.6
6,953,094 B2 10/2005 Ross et al. ..... 166/381
6,956,791 B2 10/2005 Dopf et al. ..... 367/82
6,980,929 B2 12/2005 Aronstam et al. ..... 702/188
6,987,463 B2 1/2006 Beique et al. ..... 340/856.3
7,006,918 B2 2/2006 Economides et al. ..... 702/1
7,011,157 B2 3/2006 Costley et al. ..... 166/311
7,036,601 B2 5/2006 Berg et al. ..... 166/385
7,051,812 B2 5/2006 McKee et al. ..... 166/305.1
7,064,676 B2 6/2006 Hall et al. ..... 350/853.1
7,082,993 B2 8/2006 Ayoub et al. ..... 166/250.1
7,090,020 B2 8/2006 Hill et al. ..... 166/373
7,140,434 B2 11/2006 Chouzenoux et al. .. 166/250.11
7,219,762 B2 5/2007 James et al. ..... 181/105
7,224,288 B2 5/2007 Hall et al. ..... 340/853.7
7,228,902 B2 6/2007 Oppelt ..... 166/250.02
7,249,636 B2 7/2007 Ohmer ..... 166/383
7,252,152 B2 8/2007 LoGiudice et al. ..... 166/386
7,257,050 B2 8/2007 Stewart et al. ..... 367/82
7,261,154 B2 8/2007 Hall et al. ..... 166/242.2
7,261,162 B2 8/2007 Deans et al. ..... 166/336
7,275,597 B2 10/2007 Hall et al. ..... 166/297
7,277,026 B2 10/2007 Hall et al. ..... 340/854.8
RE40,032 E 1/2008 van Borkhorst et al. ..... 455/343.2
7,317,990 B2 1/2008 Sinha et al. ..... 702/6
7,321,788 B2 1/2008 Addy et al. ..... 455/574
7,322,416 B2 1/2008 Burris, II et al. ..... 166/308.1
7,325,605 B2 2/2008 Fripp et al. ..... 166/250.01
7,339,494 B2 3/2008 Shah et al. ..... 340/855.7
7,348,893 B2 3/2008 Huang et al. ..... 340/854.3
7,385,523 B2 6/2008 Thomeer et al. ..... 340/854.8
7,387,165 B2 6/2008 Lopez de Cardenas et al. ..... 166/313
7,411,517 B2 8/2008 Flanagan ..... 340/854.4
7,477,160 B2 1/2009 Lemenager et al. ..... 340/853.1
7,516,792 B2 4/2009 Lonnes et al. ..... 166/308.1
7,551,057 B2 6/2009 King et al. ..... 340/5.72
7,590,029 B2 9/2009 Tingley ..... 367/82
7,595,737 B2 9/2009 Fink et al. ..... 340/854.4
7,602,668 B2 10/2009 Liang ..... 367/25
7,649,473 B2 1/2010 Johnson et al. ..... 340/853.1
7,750,808 B2 7/2010 Masino et al. ..... 340/572.1
7,775,279 B2 8/2010 Marya et al. ..... 166/297
7,787,327 B2 8/2010 Tang et al. ..... 367/27
7,819,188 B2 10/2010 Auzerais et al. ..... 155/250
7,828,079 B2 11/2010 Oothoudt ..... 175/20
7,831,283 B2 11/2010 Ogushi et al. ..... 455/574
7,913,773 B2 3/2011 Li et al. ..... 175/40
7,952,487 B2 5/2011 Montebovi ..... 340/636.1
7,994,932 B2 8/2011 Huang et al. ..... 340/854.3
8,004,421 B2 8/2011 Clark ..... 340/854.4
8,044,821 B2 10/2011 Mehta ..... 340/855.7
8,049,506 B2 11/2011 Lazarev ..... 324/333
8,115,651 B2 2/2012 Camwell et al. ..... 340/853.2
8,117,907 B2 2/2012 Han et al. ..... 73/152.58
8,157,008 B2 4/2012 Lilley ..... 166/253.1
8,162,050 B2 4/2012 Roddy et al. ..... 166/253.1
8,220,542 B2 7/2012 Whitsitt et al. ..... 166/278
8,237,585 B2 * 8/2012 Zimmerman ..... G01V 11/002 340/853.1
8,242,928 B2 8/2012 Prammer ..... 340/853.7
8,276,674 B2 10/2012 Lopez de Cardenas et al. ..... 166/373
8,284,075 B2 10/2012 Fincher et al. ..... 340/854.4
8,284,947 B2 10/2012 Giesbrecht et al. ..... 381/66
8,316,936 B2 11/2012 Roddy et al. ..... 166/253.1
8,330,617 B2 12/2012 Chen et al. ..... 340/854.6
8,347,982 B2 1/2013 Hannegan et al. ..... 175/5
8,358,220 B2 1/2013 Savage ..... 340/853.1
8,376,065 B2 2/2013 Teodorescu et al. ..... 175/40
8,381,822 B2 2/2013 Hales et al. ..... 166/377
8,388,899 B2 3/2013 Mitani et al. ..... 422/179
8,411,530 B2 4/2013 Slocum et al. ..... 367/90

(56) References Cited

U.S. PATENT DOCUMENTS 8,434,354 B2 5/2013 Crow et al. ..... 73/152.04
8,494,070 B2 7/2013 Luo et al. ..... 375/262
8,496,055 B2 7/2013 Mootoo et al. ..... 166/278
8,539,890 B2 9/2013 Tripp et al. ..... 109/25
8,544,564 B2 10/2013 Moore et al. ..... 175/50
8,552,597 B2 10/2013 Song et al. ..... 307/149
8,556,302 B2 10/2013 Dole ..... 285/367
8,559,272 B2 10/2013 Wang
8,596,359 B2 12/2013 Grigsby ..... 166/278
8,605,548 B2 12/2013 Froelich ..... 367/82
8,607,864 B2 12/2013 McLeod et al. ..... 166/250.1
8,664,958 B2 3/2014 Simon ..... 324/338
8,672,875 B2 3/2014 Vanderveen et al. ..... 604/67
8,675,779 B2 3/2014 Zeppetelle et al. ..... 375/340
8,683,859 B2 4/2014 Godager ..... 73/152.54
8,689,621 B2 4/2014 Godager ..... 73/152.54
8,701,480 B2 4/2014 Eriksen ..... 73/152.51
8,750,789 B2 6/2014 Baldemair et al. ..... 455/11.1
8,787,840 B2 7/2014 Srinivasan et al. ..... 455/69
8,805,632 B2 8/2014 Coman et al. ..... 702/89
8,826,980 B2 9/2014 Neer ..... 166/255.1
8,833,469 B2 9/2014 Purkis ..... 166/373
8,893,784 B2 11/2014 Abad ..... E21B 43/26
8,910,716 B2 12/2014 Newton et al. ..... 166/373
8,994,550 B2 3/2015 Millot et al. ..... E21B 47/16
8,995,837 B2 3/2015 Mizuguchi et al. ... H04B 10/27
9,062,508 B2 6/2015 Huval et al. ..... E21B 47/122
9,062,531 B2 6/2015 Jones ..... E21B 47/082
9,075,155 B2 7/2015 Luscombe et al. .... G01V 1/226
9,078,055 B2 7/2015 Nguyen et al. ..... H04R 5/00
9,091,153 B2 7/2015 Yang et al. ..... E21B 47/12
9,133,705 B2 9/2015 Angeles Boza ..... E21B 47/12
9,140,097 B2 9/2015 Themig et al. ..... E21B 34/12
9,144,894 B2 9/2015 Barnett et al. ..... B25B 17/00
9,206,645 B2 12/2015 Hallundbaek Jorgen ..... E21B 7/04
9,279,301 B2 3/2016 Lovorn et al. ..... E21B 21/103
9,284,819 B2 3/2016 Tolman et al. ..... E21B 41/00
9,284,834 B2 3/2016 Alteirac et al. ..... E21B 47/12
9,310,510 B2 4/2016 Godager ..... G01V 3/38
9,333,350 B2 5/2016 Rise et al. ..... A61N 1/36082
9,334,696 B2 5/2016 Hay ..... E21B 47/12
9,359,841 B2 6/2016 Hall ..... E21B 23/00
9,363,605 B2 6/2016 Goodman et al. ..... H04R 17/00
9,376,908 B2 6/2016 Ludwig et al. ..... E21B 47/01
9,441,470 B2 9/2016 Guerrero et al. ..... E21B 43/14
9,515,748 B2 12/2016 Jeong et al. ..... G10L 25/90
9,557,434 B2 1/2017 Keller et al. ..... G01V 1/52
9,617,829 B2 4/2017 Dale et al. ..... E21B 41/00
9,617,850 B2 4/2017 Fripp et al. ..... E21B 47/18
9,631,485 B2 4/2017 Keller et al. ..... E21B 47/16
9,657,564 B2 5/2017 Stolpman ..... E21B 47/16
9,664,037 B2 5/2017 Logan et al. ..... E21B 47/122
9,670,773 B2 6/2017 Croux ..... E21B 47/16
9,683,434 B2 6/2017 Machocki ..... E21B 44/00
9,686,021 B2 6/2017 Merino ..... E21B 47/16
9,715,031 B2 7/2017 Contant et al. ..... E21B 47/122
9,721,448 B2 8/2017 Wu et al. ..... G08B 21/20
9,759,062 B2 9/2017 Deffenbaugh et al. ..... E21B 47/16
9,816,373 B2 11/2017 Howell et al. ..... E21B 47/16
9,822,634 B2 11/2017 Gao ..... E21B 47/16
9,863,222 B2 1/2018 Morrow et al. ..... E21B 43/122
9,879,525 B2 1/2018 Morrow et al. ..... E21B 47/12
9,945,204 B2 4/2018 Ross et al. ..... E21B 33/127
9,963,955 B2 5/2018 Tolman et al. ..... E21B 43/119
10,100,635 B2 10/2018 Keller et al. ..... E21B 47/18
10,103,846 B2 10/2018 van Zelm et al. ..... E21B 47/12
10,132,149 B2 11/2018 Morrow et al. ..... E21B 43/267
10,145,228 B2 12/2018 Yarus et al. ..... E21B 44/00
10,167,716 B2 1/2019 Clawson et al. ..... E21B 47/14
10,167,717 B2 1/2019 Deffenbaugh et al. ..... E21B 47/16
10,190,410 B2 1/2019 Clawson et al. ..... E21B 47/14
10,196,862 B2 2/2019 Li-Leger et al. ..... E21B 17/02
2002/0180613 A1 12/2002 Shi et al. ..... E21B 47/18
2003/0056953 A1 3/2003 Tumlin et al. ..... 166/298
2003/0117896 A1 6/2003 Sakuma et al. ..... 367/81
2004/0020063 A1 2/2004 Lewis et al. ..... 33/313
2004/0200613 A1 10/2004 Fripp et al. ..... 166/250.01
2004/0239521 A1 12/2004 Zierolf ..... 340/854.1
2005/0269083 A1 12/2005 Burris, II et al. ..... 166/255.2
2005/0284659 A1 12/2005 Hall et al. ..... 175/27
2006/0033638 A1 2/2006 Hall et al. ..... 340/854.6
2006/0041795 A1 2/2006 Gabelmann et al. ..... 714/699
2006/0090893 A1 5/2006 Sheffield ..... 166/250.15
2007/0139217 A1 6/2007 Beique et al. ..... 340/856.3
2007/0146351 A1 6/2007 Katsurahira et al. ..... 345/179
2007/0156359 A1 7/2007 Varsamis ..... 702/69
2007/0219758 A1 9/2007 Bloomfield ..... 702/190
2007/0272411 A1 11/2007 Lopez de Cardenas et al. ..... 166/305.1
2008/0030365 A1 2/2008 Fripp ..... E21B 47/16
2008/0110644 A1 5/2008 Howell ..... 166/387
2008/0185144 A1 8/2008 Lovell ..... 166/250.17
2008/0304360 A1 12/2008 Mozer ..... 367/117
2009/0003133 A1 1/2009 Dalton ..... 367/82
2009/0030614 A1 1/2009 Carnegie ..... 702/6
2009/0034368 A1 2/2009 Johnson ..... 367/83
2009/0045974 A1 2/2009 Patel ..... 340/854.6
2009/0080291 A1 3/2009 Tubel et al. ..... 367/81
2009/0166031 A1 7/2009 Hernandez ..... 166/250.01
2010/0013663 A1 1/2010 Cavender et al. ..... 340/854.3
2010/0089141 A1 4/2010 Rioufol et al. ..... 73/152.28
2010/0133004 A1 6/2010 Burleson et al. ..... 175/2
2010/0182161 A1 7/2010 Robbins et al. ..... 340/853.7
2010/0212891 A1 8/2010 Stewart et al. ..... 166/250.12
2011/0061862 A1 3/2011 Loretz et al. ..... 166/250.11
2011/0066378 A1 3/2011 Lerche et al. ..... 702/6
2011/0168403 A1 7/2011 Patel ..... 166/373
2011/0176387 A1 7/2011 Froelich
2011/0188345 A1 8/2011 Wang ..... 367/34
2011/0297376 A1 12/2011 Holderman et al. ..... 166/278
2011/0297673 A1 12/2011 Zbat et al. ..... 219/756
2011/0301439 A1 12/2011 Albert et al. ..... 600/301
2011/0315377 A1 12/2011 Rioufol ..... 166/250.17
2012/0043079 A1 2/2012 Wassouf et al. ..... 166/250
2012/0126992 A1 5/2012 Rodney et al. ..... 340/850
2012/0152562 A1 6/2012 Newton et al. ..... 166/369
2012/0179377 A1 7/2012 Lie ..... 702/6
2012/0286967 A1* 11/2012 Alteirac ..... E21B 47/12 340/853.7
2013/0000981 A1* 1/2013 Grimmer ..... E21B 47/10 175/45
2013/0003503 A1 1/2013 L'Her et al. ..... 367/106
2013/0106615 A1 5/2013 Prammer ..... 340/854.6
2013/0138254 A1 5/2013 Seals et al. ..... 700/282
2013/0192823 A1 8/2013 Barrilleaux et al. ..... 166/250.01
2013/0248172 A1 9/2013 Angeles Boza et al.
2013/0278432 A1 10/2013 Shashoua et al. ..... 340/853.7
2013/0319102 A1 12/2013 Riggenberg et al. ..... 73/152.28
2014/0060840 A1 3/2014 Hartshorne et al. ..... 166/300
2014/0062715 A1 3/2014 Clark ..... 340/853.2
2014/0102708 A1 4/2014 Purkis et al. ..... 166/308.1
2014/0133276 A1 5/2014 Volker et al. ..... 367/82
2014/0152659 A1 6/2014 Davidson et al. ..... 345/420
2014/0153368 A1 6/2014 Bar-Cohen et al. ..... 367/81
2014/0166266 A1 6/2014 Read ..... 166/250.01
2014/0170025 A1 6/2014 Weiner et al. ..... 422/82.01
2014/0266769 A1 9/2014 van Zelm ..... 340/854.3
2014/0327552 A1 11/2014 Filas et al. ..... 340/854.6
2014/0352955 A1 12/2014 Tubel et al. ..... 166/250.15
2015/0003202 A1 1/2015 Palmer et al. ..... 367/82
2015/0009040 A1 1/2015 Bowles et al. ..... 340/854.6
2015/0027687 A1 1/2015 Tubel ..... 166/72
2015/0041124 A1 2/2015 Rodriguez ..... 166/255.1
2015/0041137 A1 2/2015 Rodriguez ..... 166/301
2015/0152727 A1 6/2015 Fripp et al. ..... E21B 47/14
2015/0159481 A1 6/2015 Mebarkia et al. .... E21B 47/065
2015/0167425 A1 6/2015 Hammer et al. ..... E21B 34/06
2015/0176370 A1 6/2015 Greening et al. ..... E21B 41/00
2015/0292319 A1 10/2015 Disko et al. ..... E21B 47/16
2015/0292320 A1 10/2015 Lynk et al. ..... E21B 47/16
2015/0300159 A1 10/2015 Stiles et al. ..... E21B 47/16

(56) References Cited

U.S. PATENT DOCUMENTS

| | | | | |
|---|---|---|---|---|
| 2015/0330200 | A1 | 11/2015 | Richard et al. | E21B 44/00 |
| 2015/0337642 | A1 | 11/2015 | Spacek | E21B 44/005 |
| 2015/0354351 | A1 | 12/2015 | Morrow et al. | E21B 47/16 |
| 2015/0377016 | A1 | 12/2015 | Ahmad | E21B 47/122 |
| 2016/0010446 | A1 | 1/2016 | Logan et al. | E21B 47/122 |
| 2016/0047230 | A1 | 2/2016 | Livescu et al. | E21B 47/10 |
| 2016/0047233 | A1 | 2/2016 | Butner et al. | E21B 47/12 |
| 2016/0076363 | A1 | 3/2016 | Morrow et al. | E21B 47/12 |
| 2016/0109606 | A1 | 4/2016 | Market et al. | G01V 1/50 |
| 2016/0145991 | A1* | 5/2016 | Yarus | E21B 44/00 700/275 |
| 2016/0215612 | A1* | 7/2016 | Morrow | E21B 47/01 |
| 2016/0237759 | A1 | 8/2016 | Li-Leger et al. | |
| 2017/0138185 | A1 | 5/2017 | Saed et al. | E21B 47/16 |
| 2017/0145811 | A1 | 5/2017 | Robison et al. | E21B 47/0007 |
| 2017/0152741 | A1 | 6/2017 | Park et al. | E21B 47/123 |
| 2017/0167249 | A1 | 6/2017 | Lee et al. | E21B 47/14 |
| 2017/0204719 | A1* | 7/2017 | Babakhani | E21B 47/0005 |
| 2017/0254183 | A1 | 9/2017 | Vasques et al. | E21B 47/16 |
| 2017/0293044 | A1 | 10/2017 | Gilstrap et al. | G01V 1/50 |
| 2017/0314386 | A1 | 11/2017 | Orban et al. | E21B 47/091 |
| 2018/0010449 | A1 | 1/2018 | Roberson et al. | E21B 47/16 |
| 2018/0058191 | A1 | 3/2018 | Romer et al. | E21B 47/0007 |
| 2018/0058198 | A1 | 3/2018 | Ertas et al. | E21B 47/12 |
| 2018/0058202 | A1 | 3/2018 | Disko et al. | E21B 47/14 |
| 2018/0058203 | A1 | 3/2018 | Clawson et al. | E21B 47/14 |
| 2018/0058204 | A1 | 3/2018 | Clawson et al. | E21B 47/14 |
| 2018/0058205 | A1 | 3/2018 | Clawson et al. | E21B 47/14 |
| 2018/0058206 | A1 | 3/2018 | Zhang et al. | E21B 47/16 |
| 2018/0058207 | A1 | 3/2018 | Song et al. | E21B 47/16 |
| 2018/0058208 | A1 | 3/2018 | Song et al. | E21B 47/16 |
| 2018/0058209 | A1 | 3/2018 | Song et al. | E21B 47/16 |
| 2018/0066490 | A1 | 3/2018 | Kjos | E21B 33/035 |
| 2018/0066510 | A1 | 3/2018 | Walker et al. | E21B 47/011 |

FOREIGN PATENT DOCUMENTS

| | | | | |
|---|---|---|---|---|
| EP | 1 467 060 | A1 | 10/2004 | |
| EP | 1409839 | | 4/2005 | E21B 43/1185 |
| EP | 2677698 | | 12/2013 | H04L 12/28 |
| WO | WO 02/27139 | A1 | 4/2002 | |
| WO | WO2002/027139 | | 4/2002 | E21B 43/12 |
| WO | WO2010/074766 | | 7/2010 | A41C 1/14 |
| WO | WO2013/079928 | | 6/2013 | E21B 47/12 |
| WO | WO 2013/079928 | A2 | 6/2013 | |
| WO | WO 2013/112273 | A2 | 8/2013 | |
| WO | WO2014/018010 | | 1/2014 | E21B 47/12 |
| WO | WO 2014/018010 | A1 | 1/2014 | |
| WO | WO2014/049360 | | 4/2014 | E21B 47/12 |
| WO | WO 2014/049360 | A2 | 4/2014 | |
| WO | WO2014/100271 | | 6/2014 | E21B 47/13 |
| WO | WO2014/134741 | | 9/2014 | E21B 47/13 |
| WO | WO 2014/134741 | A1 | 9/2014 | |
| WO | WO2015/117060 | | 8/2015 | E21B 47/12 |

OTHER PUBLICATIONS

U.S. Appl. No. 16/139,373, filed Sep. 24, 2018, Yi, Xiaohua et al.
U.S. Appl. No. 16/139,384, filed Oct. 13, 2017, Disko, Mark M. et al.
U.S. Appl. No. 16/139,394, filed Oct. 13, 2017, Song, Limin et al.
U.S. Appl. No. 16/139,403, filed Oct. 13, 2017, Song, Limin et al.
U.S. Appl. No. 16/139,414, filed Oct. 13, 2017, Zhang, Yibing et al.
U.S. Appl. No. 16/139,421, filed Oct. 13, 2017, Song, Limin et al.
U.S. Appl. No. 16/139,427, filed Oct. 13, 2017, Disko, Mark M. et al.
U.S. Appl. No. 16/175,418, filed Oct. 30, 2018, Kent, David K. et al.
U.S. Appl. No. 62/588,067, filed Nov. 17, 2017, Song, Limin et al.
U.S. Appl. No. 62/588,080, filed Nov. 17, 2017, Kinn, Timothy F. et al.
U.S. Appl. No. 62/588,103, filed Nov. 17, 2017, Yi, Xiaohua et al.
Arroyo, Javier et al. (2009) "Forecasting Histogram Time Series with K-Nearest Neighbours Methods," *International Journal of Forecasting*, v.25, pp. 192-207.
Arroyo, Javier et al. (2011) "Smoothing Methods for Histogram-Valued Time Seriers: An Application to Value-at-Risk," *Univ. of California, Dept. of Economics*, www.wileyonlinelibrary.com, Mar. 8, 2011, 28 pages.
Arroyo, Javier et al. (2011) "Forecasting with Interval and Histogram Data Some Financial Applications," *Univ. of California, Dept. of Economics*, 46 pages.
Emerson Process Management (2011), "Roxar downhole Wireless PT sensor system," www.roxar.com, or downhole@roxar.com, 2 pgs.
Gonzalez-Rivera, Gloria et al. (2012) "Time Series Modeling of Histogram-Valued Data: The Daily Histogram Time Series of S&P500 Intradaily Returns," *International Journal of Forecasting*, v.28, 36 pgs.
Gutierrez-Estevez, M. A. et al. (2013) "Acoustic Boardband Communications Over Deep Drill Strings using Adaptive OFDM", *IEEE Wireless Comm. & Networking Conf.*, pp. 4089-4094.
Qu, X. et al. (2011) "Reconstruction fo Self-Sparse 20 NMR Spectra From undersampled Data In The Indirect Dimension", pp. 8888-8909.
U.S. Department of Defense (1999) "Interoperability and Performance Standards for Medium and High Frequency Radio Systems," MIL-STD-188-141B, Mar. 1, 1999, 584 pages.

* cited by examiner

RESERVOIR FORMATION CHARACTERIZATION USING A DOWNHOLE WIRELESS NETWORK

CROSS REFERENCE TO RELATED APPLICATION

This application claims the benefit of U.S. Provisional Application Ser. No. 62/428,380, filed Nov. 30, 2016 entitled "Reservoir Formation Characterization Using A Downhole Wireless Network," U.S. Provisional Application Ser. No. 62/381,330, filed Aug. 30, 2016, entitled "Communication Networks, Relay Nodes for Communication Networks, and Methods of Transmitting Data Among a Plurality of Relay Nodes," U.S. Provisional Application Ser. No. 62/381,335, filed Aug. 30, 2016 entitled "Zonal Isolation Devices Including Sensing and Wireless Telemetry and Methods of Utilizing the Same," U.S. Provisional Application Ser. No. 62/428,367, filed Nov. 30, 2016, entitled "Dual Transducer Communications Node for Downhole Acoustic Wireless Networks and Method Employing Same," U.S. Provisional Application Ser. No. 62/428,374, filed Nov. 30, 2016, entitled "Hybrid Downhole Acoustic Wireless Network," U.S. Provisional Application Ser. No. 62/433,491, filed Dec. 13, 2016 entitled "Methods of Acoustically Communicating And Wells That Utilize The Methods," and U.S. Provisional Application Ser. No. 62/428,425 filed Nov. 30, 2016, entitled "Acoustic Housing for Tubulars," the disclosures of which are incorporated herein by reference in their entireties.

FIELD

The present disclosure relates generally to the field of data transmission along a tubular body, such as a steel pipe. More specifically, the present disclosure relates to systems and methods for reservoir formation characterization.

BACKGROUND

In the oil and gas industry, it is desirable to obtain data from a wellbore. Several real time data systems have been proposed. One involves the use of a physical cable such as an electrical conductor or a fiber optic cable that is secured to the tubular body. The cable may be secured to either the inner or the outer diameter of the pipe. The cable provides a hard wire connection that allows for real-time transmission of data and the immediate evaluation of subsurface conditions. Further, these cables allow for high data transmission rates and the delivery of electrical power directly to downhole sensors.

It has been proposed to place a physical cable along the outside of a casing string during well completion. However, this can be difficult as the placement of wires along a pipe string requires that thousands of feet of cable be carefully unspooled and fed during pipe connection and run-in. Further, the use of hard wires in a well completion requires the installation of a specially-designed well head that includes through-openings for the wires.

Various wireless technologies have been proposed or developed for downhole communications. Such technologies are referred to in the industry as telemetry. Several examples exist where the installation of wires may be either technically difficult or economically impractical. The use of radio transmission may also be impractical or unavailable in cases where radio-activated blasting is occurring, or where the attenuation of radio waves near the tubular body is significant.

The use of acoustic telemetry has also been suggested. Acoustic telemetry employs an acoustic signal generated at or near the bottom hole assembly or bottom of a pipe string. The signal is transmitted through the wellbore pipe, meaning that the pipe becomes the carrier medium for sound waves. Transmitted sound waves are detected by a receiver and converted to electrical signals for analysis.

Reservoir and formation characterization is critical to production zone assessment and optimization. For example, information regarding reservoir rock conditions, such as porosity, permeability, and hydrocarbon accumulation are important reservoir properties. Understanding of reservoir rock properties is crucial in developing a prospect.

Accordingly, a need exists for systems and methods for reservoir and formation characterization that can be updated in real-time.

SUMMARY

In one aspect, provided is a system for reservoir formation characterization, comprising: at least one sensor disposed along a tubular body configured to sense one or more reservoir formation parameters indicative of at least one reservoir formation property; at least one sensor communications node placed along the tubular body and affixed to a wall of the tubular body, the sensor communications node being in communication with the at least one sensor and configured to receive signals therefrom; a topside communications node placed proximate a surface; a plurality of intermediate communications nodes spaced along the tubular body and attached to a wall of the tubular body, wherein the intermediate communications nodes are configured to transmit signals received from the at least one sensor communications node to the topside communications node in substantially a node-to-node arrangement; a receiver at the surface configured to receive signals from the topside communications node; and a topside data acquisition system structured and arranged to communicate with the topside communications node.

In some embodiments, the plurality of intermediate communications nodes are configured to transmit acoustic waves, radio waves, low frequency electromagnetic waves, inductive electromagnetic waves, light, or combinations thereof.

In some embodiments, the at least one sensor communications node is configured to transmit acoustic waves, radio waves, low frequency electromagnetic waves, inductive electromagnetic waves, light, or combinations thereof.

In some embodiments, the plurality of intermediate communications nodes and the at least one sensor communications node are configured to transmit acoustic waves, providing real-time information to the topside data acquisition system.

In some embodiments, each of the plurality of intermediate communications nodes comprises: a sealed housing; a power source residing within the housing; and at least one electro-acoustic transducer.

In some embodiments, each of the plurality of intermediate communications nodes further comprises a transceiver or a separate transmitter and receiver associated with the at least one electro-acoustic transducer structured and arranged to receive and re-transmit the acoustic waves.

In some embodiments, the at least one sensor communications node comprises: a sealed housing; a power source residing within the housing; and at least one electro-acoustic transducer.

In some embodiments, the at least one sensor communications node further comprises a transceiver or a separate transmitter and receiver associated with the at least one electro-acoustic transducer that is structured and arranged to communicate with the at least one sensor and transmit acoustic waves in response thereto.

In some embodiments, the acoustic waves represent asynchronous packets of information comprising a plurality of separate tones, with at least some of the acoustic waves being indicative of one or more reservoir formation parameters indicative of at least one reservoir formation property.

In some embodiments, the at least one sensor is selected from one or more of a fluid density sensor, a fluid resistivity sensor, a fluid velocity sensor, a pressure drop sensor, a scintillation detector, a temperature sensor, a vibration sensor; a pressure sensor; a microphone; an ultrasound sensor; a Doppler shift sensor; a chemical sensor; an imaging device; an impedance sensor; an attenuation sensor or a combination thereof. In some embodiments, the at least one sensor comprises a plurality of sensors.

In some embodiments, the at least one sensor employs passive acoustic monitoring, active acoustic measurements, electromagnetic signature detection, sonar monitoring, radar monitoring, or radiation monitoring.

In some embodiments, permeability is determined using a model employing pressure, vibration, and temperature measurements.

In some embodiments, the one or more reservoir formation parameters are pressure, vibration, and temperature, which are used to determine permeability.

In some embodiments, data transmitted topside is utilized by the topside data acquisition system for reservoir formation characterization and production optimization.

In another aspect, provided is a downhole wireless telemetry system. The downhole wireless telemetry system includes at least one sensor disposed along a tubular body; at least one sensor communications node placed along the tubular body and affixed to a wall of the tubular body, the sensor communications node being in electrical communication with the at least one sensor and configured to receive signals therefrom; a topside communications node placed proximate a surface; a plurality of electro-acoustic communications nodes spaced along the tubular body and attached to a wall of the tubular body, each electro-acoustic communications node comprising a housing having a mounting face for mounting to a surface of the tubular body; a piezoelectric receiver positioned within the housing, the piezoelectric receiver structured and arranged to receive acoustic waves that propagate through the tubular body; a piezoelectric transmitter positioned within the housing, the piezoelectric transmitter structured and arranged to transmit acoustic waves through the tubular body; and a power source comprising one or more batteries positioned within the housing; wherein the electro-acoustic communications nodes are configured to transmit signals received from the at least one sensor communications node to the topside communications node in a substantially node-to-node arrangement.

In some embodiments, the piezoelectric receiver also functions as a power receiver to convert sound and vibration energy into electrical power via an energy harvesting electronics. In some embodiments, the energy harvesting electronics includes a super-capacitor or chargeable batteries.

In some embodiments, the electro-acoustic communications node further includes separate electronics circuits to optimize the performance of the piezoelectric receiver and the piezoelectric transmitter.

In some embodiments, the piezoelectric transmitter comprises multiple piezoelectric disks, each piezoelectric disk having at least a pair of electrodes connected in series with an adjacent piezoelectric disk. In some embodiments, a single voltage is applied equally to each piezoelectric disk. In some embodiments, the mechanical output of the piezoelectric transmitter is increased by increasing the number of disks while applying the same voltage.

In some embodiments, the piezoelectric receiver comprises multiple piezoelectric disks, each piezoelectric disk having at least a pair of electrodes connected in series with an adjacent piezoelectric disk. In some embodiments, the piezoelectric receiver comprises a single piezoelectric disk, the single piezoelectric disk having a thickness equivalent to the total thickness of a multiple piezoelectric disk.

In some embodiments, the housing has a first end and a second end, each of which have a clamp associated therewith for clamping to an outer surface of the tubular body.

In yet another aspect, provided is a method for reservoir formation characterization of a well, such as a production well. The method includes sensing one or more reservoir formation parameters indicative of at least one reservoir formation property via one or more sensors positioned along a tubular body; receiving signals from the one or more sensors with at least one sensor communications node; transmitting those signals via a transmitter or transceiver to an intermediate communications node attached to a wall of the tubular body; transmitting signals received by the intermediate communications node to at least one additional intermediate communications node via a transmitter or transceiver; transmitting signals received by the intermediate communications node to a topside communications node or a virtual topside communication node via a transmitter or transceiver; determining at least one reservoir formation property from the signals received from the topside communications node; and updating a reservoir formation model in response to signals received from the topside communications node and optimizing production performance.

In some embodiments, the intermediate communications nodes are configured to transmit acoustic waves, radio waves, low frequency electromagnetic waves, inductive electromagnetic waves, light, or combinations thereof.

In some embodiments, the step of transmitting the signals received from the one or more sensors via a transmitter employs at least one sensor communications node configured to transmit acoustic waves, radio waves, low frequency electromagnetic waves, inductive electromagnetic waves, light, or combinations thereof.

In some embodiments, the intermediate communications nodes and the at least one sensor communications node are configured to transmit acoustic waves, providing real-time information to the reservoir formation model.

In some embodiments, each of the intermediate communications nodes comprises: a sealed housing; a power source residing within the housing; and at least one electro-acoustic transducer.

In some embodiments, each of the intermediate communications nodes further comprises a transceiver or a separate transmitter and receiver associated with the at least one electro-acoustic transducer structured and arranged to receive and re-transmit the acoustic waves.

In some embodiments, the at least one sensor communications node comprises: a sealed housing; a power source residing within the housing; and at least one electro-acoustic transducer.

In some embodiments, the at least one sensor communications node further comprises a transceiver or a separate transmitter and receiver associated with the at least one electro-acoustic transducer that is structured and arranged to communicate with the at least one sensor and transmit acoustic waves in response thereto.

In some embodiments, the acoustic waves represent asynchronous packets of information comprising a plurality of separate tones, with at least some of the acoustic waves being indicative of one or more reservoir formation parameters indicative of at least one reservoir formation property.

In some embodiments, the one or more sensors are selected from one or more of a fluid density sensor, a fluid resistivity sensor, a fluid velocity sensor, a pressure drop sensor, a scintillation detector, a temperature sensor, a vibration sensor; a pressure sensor; a microphone; an ultrasound sensor; a Doppler shift sensor; a chemical sensor; an imaging device; an impedance sensor; an attenuation sensor or a combination thereof.

In some embodiments, the method further includes: sending an acoustic signal from an intermediate communications node; and determining from the acoustic response a physical property of the reservoir formation. In some embodiments, the aforementioned method further includes repeating the sending step at a different time, and measuring the change in acoustic response to determine whether a physical change in reservoir formation conditions or properties has occurred.

In some embodiments, the physical change in reservoir formation conditions includes a change in fluid in the tubular body, a change in cement condition over time, or a change in tubular body integrity over time.

In some embodiments, the physical change in reservoir or tubular conditions includes a change in sand production that is produced through the tubular body, or a change in precipitation or accumulation of scale or paraffin on the inner wall of the tubular body that may lead to flow restriction, corrosion, mechanical failure, or production inefficiencies.

BRIEF DESCRIPTION OF THE DRAWINGS

The present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation. The forms disclosed herein are illustrated by way of example, and not by way of limitation, in the figures of the accompanying drawings and in which like reference numerals refer to similar elements and in which:

DETAILED DESCRIPTION

Terminology

Figure 1:
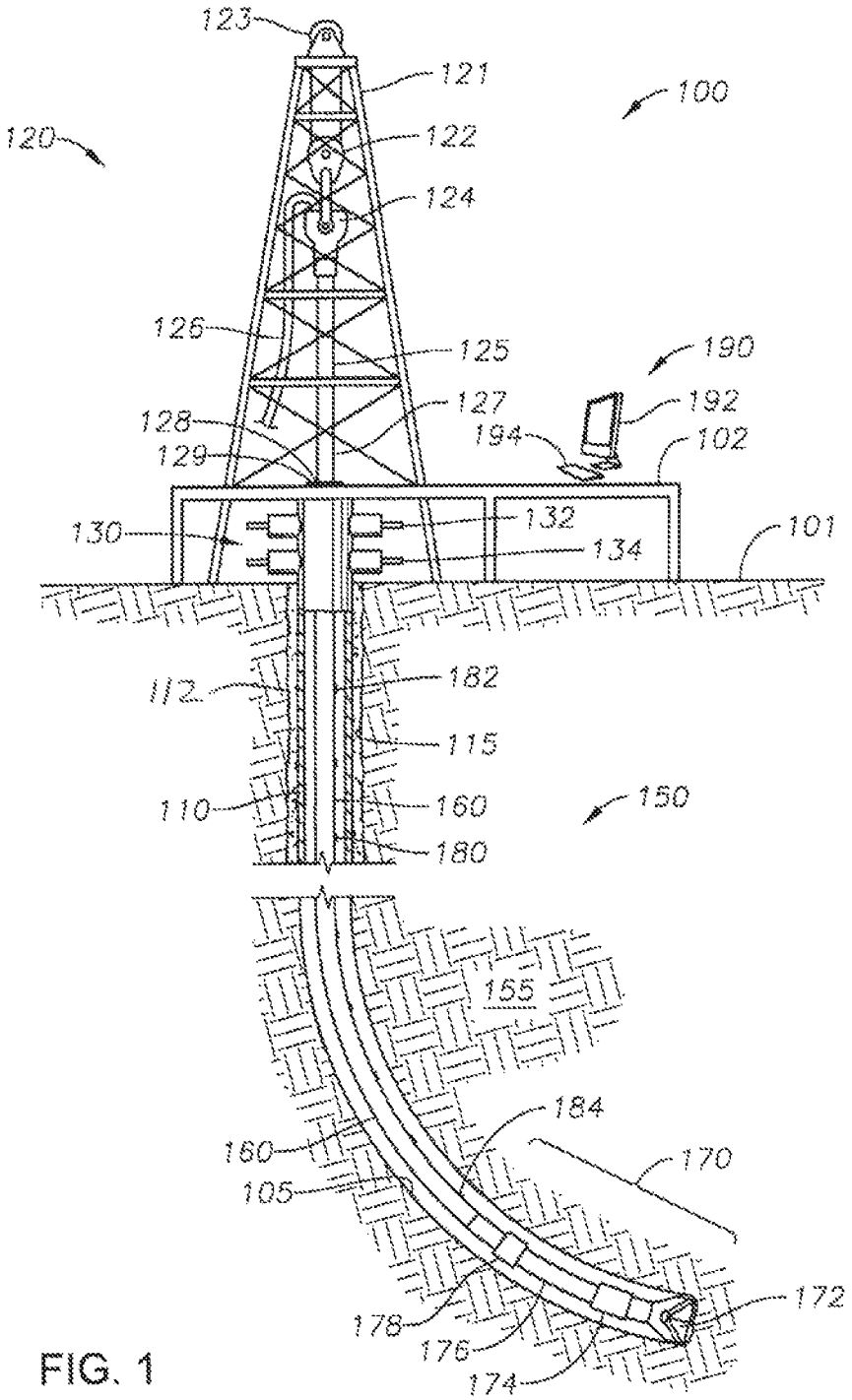
FIG. 1 presents a side, cross-sectional view of an illustrative, nonexclusive example of a wellbore. The wellbore is being formed using a derrick, a drill string and a bottom hole assembly. A series of communications nodes is placed along the drill string as part of a telemetry system, according to the present disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Above/below: In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of" will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of".

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Based on: "Based on" does not mean "based only on", unless expressly specified otherwise. In other words, the phrase "based on" describes both "based only on," "based at least on," and "based at least in part on."

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Configured: As used herein the term "configured" means that the element, component, or other subject matter is designed to perform a given function. Thus, the use of the term "configured" should not be construed to mean that a given element, component, or other subject matter is simply "capable of" performing a given function but that the element, component, and/or other subject matter is specifically selected, created, implemented, utilized, programmed, and/or designed to perform that function.

Couple: Any use of any form of the terms "connect", "engage", "couple", "attach", or any other term describing an interaction between elements is not meant to limit the interaction to direct interaction between the elements and may also include indirect interaction between the elements described.

Determining: "Determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

Embodiments: Reference throughout the specification to "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics may be combined in any suitable manner in one or more embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

Flow: As used herein, the term "flow" refers to a current or stream of a fluid. Flow can be understood as the quantity of a fluid that passes a point per unit time. Factors that affect flow can include, but are not limited to, pressure (flow is directly proportional to the pressure difference across a tube), radius (flow is directly proportional to the fourth power of the radius of a tube), length (flow is inversely proportional to the length of a tube), viscosity (flow is inversely proportional to the viscosity of the fluid), temperature of the fluid, fluid density, compressibility of the fluid, single phase or multiphase fluid, friction, and chemical properties of the fluid.

Flow diagram: Exemplary methods may be better appreciated with reference to flow diagrams or flow charts. While for purposes of simplicity of explanation, the illustrated methods are shown and described as a series of blocks, it is to be appreciated that the methods are not limited by the order of the blocks, as in different embodiments some blocks may occur in different orders and/or concurrently with other blocks from that shown and described. Moreover, less than all the illustrated blocks may be required to implement an exemplary method. In some examples, blocks may be combined, may be separated into multiple components, may employ additional blocks, and so on. In some examples, blocks may be implemented in logic. In other examples, processing blocks may represent functions and/or actions performed by functionally equivalent circuits (e.g., an analog circuit, a digital signal processor circuit, an application specific integrated circuit (ASIC)), or other logic device. Blocks may represent executable instructions that cause a computer, processor, and/or logic device to respond, to perform an action(s), to change states, and/or to make decisions. While the figures illustrate various actions occurring in serial, it is to be appreciated that in some examples various actions could occur concurrently, substantially in series, and/or at substantially different points in time. In some examples, methods may be implemented as processor executable instructions. Thus, a machine-readable medium may store processor executable instructions that if executed by a machine (e.g., processor) cause the machine to perform a method.

Flow probe: As used herein, the term "flow probe" refers to one or more sensors for measuring a parameter related to local flow. Such flow parameters may include, fluid velocity, volumetric or mass flow rates of individual phases of a multiphase fluid through a pipe, density, relative density, weight density, acoustic impedance, impedance, viscosity, dynamic viscosity, density, temperature, multiphase flow type, and the like. Suitable flow probes can include sensors including, but are not limited to, one or more of a multiphase flow meter for measuring or monitoring the volumetric or mass flow rates of individual phases of a multiphase fluid through a pipe, differential pressure meters, pitot tubes, pitot array sensors, ultrasound Doppler, gamma ray absorption, fluid density, and the like. The mass flow rates of the phases can be computed by measuring component densities.

Flow rate: As used herein, the term "flow rate" refers to the speed or velocity, of fluid flow through a pipe or vessel.

Fluid: As used herein, the term "fluid" refers to gases, liquids, and combinations of gases and liquids, as well as to combinations of gases and solids, combinations of liquids and solids, and combinations of gases, liquids, and solids.

Fluid flow measurement: As used herein, the term "fluid flow measurement" refers to measuring one or more fluid flow parameters including but not limited to, one or more of velocity, volume, pressure, resistivity, vibration, pressure drop, temperature, impedance, attenuation, density, viscosity, flow type, and the like. Such measurements can be used to determine, for example, fluid velocity, fluid composition, phase fraction, annular distribution of flows and phases across a cross-section, flow rate, and the like. This information can be used to diagnose downhole fluid production performance issues as described herein.

Formation: As used herein, the term "formation" refers to any definable subsurface region. The formation may contain one or more hydrocarbon-containing layers, one or more non-hydrocarbon containing layers, an overburden, and/or an underburden of any geologic formation.

Formation fluid: As used herein, the term "formation fluid" refers to fluid, e.g., gas, oil, or water that exists in a subsurface formation.

Reservoir formation parameter: As used herein, the term "reservoir formation parameter" refers to one or more parameters that can be determined, for example, by sensing using one or more sensors that are indicative of at least one reservoir formation property. Such reservoir formation properties can include but are not limited to porosity of reservoir rock, permeability of reservoir rock, composition, hydrocarbon accumulation, fluid properties, fluid flow properties, phase properties, flow type, composition, and the like. Such reservoir formation properties can also include but are not limited to physical properties including but not limited to those described hereinabove. Such reservoir formation parameters can include but are not limited to, one or more of temperature, pressure, pressure drop, vibration, formation density, density, resistivity, impedance, attenuation, fluid velocity, and the like.

Reservoir formation parameters can be sensed using one or more sensors including but not limited to vibration sensors including for example acoustic vibration sensors; fluid velocity measurement devices, for example, residing inside of a tubular; temperature sensors, e.g., that measure temperature of fluids, e.g., flowing inside of a tubular; pressure sensors that measure pressure inside of a tubular, or pressure drop; fluid density sensors that measure the density of fluids inside of a tubular; microphones that provide passive acoustic monitoring to listen for the sound of gas entry into a tubular or the opening and closing of a gas lift valve, e.g., at a frequency characteristic of flowing fluids, including for example, but not limited to about <20 kHz, <25 kHz, from >0 to <20 kHz, or from >1 to less than 20 kHz; ultrasound sensors that correlate changes in gas transmission with gas flows, bubbles, solids and other properties of flow along gas inlets; Doppler shift sensors; chemical sensors; an imaging device; impedance sensors; devices to measure acoustic attenuation; temperature sensors; and combinations thereof.

Sensor nodes can detect and measure reservoir formation parameters that are indicative of one or more reservoir formation properties as presently described, including but not limited to porosity, permeability, hydrocarbon accumulation, etc. as a function of time without interrupting production, by a number of means including, but not limited to, the following:

- Passive acoustic monitoring, e.g., listening for the sound of gas entry into a tubular, e.g., production tubing, from one or more sound or acoustic vibration sensors located on the sensing nodes.
- Active acoustic measurements where vibration waves are excited at one or more sensing nodes, propagated into a varying depth of a permeable zone (for example log vibration frequencies penetrate more deeply than higher frequencies) and received by one or more acoustic vibration receivers on the sending node, or on one or more receivers at varying distances away from the original sender.
- Measurement of the fluid density inside a tubular, e.g., production tubing.
- Measurement of the fluid resistivity inside a tubular, e.g., production tubing using electrical impedance or other direct (sensor exposed to the fluids) or indirect sensors (e.g. combination with passive or active devices/taggants within the flow).
- Measurement of the environment (formation, near wellbore conditions) permeability outside production tubing using combinations of pressure, vibrations, and temperature ("sensor fusion" with a model) or direct measures using gamma ray sources, low frequency electromagnetic waves (e.g. sub-MHz), and/or other means.
- Measurement of the pressure drop across production tubing using transducers exposed directly to flowing media.
- Measurement of the fluid velocity or flow rate inside a tubular, e.g., production tubing.
- Methods to integrate one or more of the measurements described above with a permeability/production model and use of these to optimize stimulation from injection wells, and/or control topside and down-hole flow control devices including screens, valves and other tools, for example, as described herein.

Full-physics: As used herein, the term "full-physics," "full physics computational simulation," or "full physics simulation" refers to a mathematical algorithm based on first principles that impact the pertinent response of the simulated system.

Gas: As used herein, the term "gas" refers to a fluid that is in its vapor phase.

Hydrocarbon: As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Examples of hydrocarbon-containing materials include any form of natural gas, oil, coal, and bitumen that can be used as a fuel or upgraded into a fuel.

Hydrocarbon fluids: As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (15° C. to 20° C. and 1 atm pressure). Hydrocarbon fluids may include, for example, oil, natural gas, gas condensates, coal bed methane, shale oil, shale gas, pyrolysis oil, pyrolysis gas, a pyrolysis product of coal, and other hydrocarbons that are in a gaseous or liquid state.

Inflow control device or valve: As used herein, the term "inflow control device" or "inflow control valve" (ICD) refers to control device that is a component installed as part of a well completion to optimize production by equalizing reservoir inflow along the length of the wellbore. Multiple inflow control devices can be installed along the reservoir section of the completion, with, for example, each device employing a specific setting to partially choke flow. The resulting arrangement can be used to delay water or gas breakthrough by reducing annular velocity across a selected interval such as the heel of a horizontal well. Inflow control devices can be used with sand screens on openhole completions. ICDs can enable the adjustment of flow from individual zones of a production well including one or more production zones of a multi-zone production well, that are over- or under-pressured or from those producing water or gas that may be detrimental to overall well productivity. Downhole inflow control devices can slow water and gas encroachment and reduce the amount of bypassed reserves by equalizing a pressure drop along a length of a wellbore, so as to promote uniform flow of oil and gas through a formation so that the arrivals of water and gas are delayed and simultaneous. Suitable ICDs include, but are not limited to, one or more of passive ICDs, nozzle-based ICDs, orifice ICDs, channel ICDs, helical-channel ICDs, ResFlow ICDs, autonomous ICDs (AICDs), and ICDs that are tube-channel and orifice-nozzle combinations. ICDs suitable for use according to the presently described subject matter can include EQUIFLOW autonomous ICDs (Halliburton ICDs) can be used to manage fluid outflow in injection wells. ICDs can be placed both in injection and producer wells.

Fluid flow from one or more well zones can be shut off or reduced using one or more downhole valves, for example, one or more remotely actuated downhole valves.

The presently described systems and methods can include and/or utilize for example, but are not limited to, one or more control devices, including for example, one or more of inflow control devices, autonomous inflow control devices, outflow control devices, valves and corresponding actuation devices, wellbore isolation devices including for example, tool seals, packers, cement plugs, bridge plugs, chemical control devices, and the like as described herein.

Lithology: As used herein, the term "lithology" refers to a description of the rock's physical characteristics, such as grain size, composition and texture. Using, for example, a combination of measurements, such as gamma, neutron, density and resistivity, lithology can be determined downhole.

May: Note that the word "may" is used throughout this application in a permissive sense (i.e., having the potential to, being able to), not a mandatory sense (i.e., must).

Material probe: As used herein, the term "material probe" refers to one or more sensor devices or methods that can measure a parameter related to material properties, e.g., surrounding the material probe or sensor communications node containing the material probe. For example, a material probe can measure acoustic energy loss to a surrounding medium, e.g., a hydrocarbon containing fluid. Such material parameters may include, but are not limited to, one or more of acoustic impedance, impedance, acoustic noise, density, weight density, relative density, pressure, viscosity, salinity, and the like. The material probe can include but is not limited to, a sensing device and/or method that measures the acoustic energy loss to the surrounding fluid medium, the fluid medium including for example, but not limited to, gas, water, oil, or a mixture thereof, and uses that data to determine the nature of the fluid medium, i.e., whether the medium includes gas, water, oil, or a mixture thereof. Suitable material probes can include but are not limited to piezoelectric transducers. Acoustic energy loss to the fluid can be determined by methods including but not limited to, for example, measuring electrical impedance of the piezo, and measuring acoustic attenuation with, for example, a Pulse-Echo/Tx-Rx method. Each method serves to identify the components of the fluid medium.

Near real time: As used herein, the terms "near real-time" and "real-time" are used interchangeably and refer to the systems and methods, including the presently described systems and methods, where the time delay introduced, by automated data processing or network transmission, between the occurrence of an event and the use of the processed data, such as for display or feedback and control purposes. For example, a near-real-time or real-time display depicts an event or situation as it existed at the current time minus the processing time, as nearly the time of the live event. The time delay with regard to "near real-time" or "real-time" can be on the order of several milliseconds to several minutes, several milliseconds to several seconds, or several seconds to several minutes.

Oil: As used herein, the term "oil" refers to a hydrocarbon fluid including a mixture of condensable hydrocarbons.

Operatively connected and/or coupled: Operatively connected and/or coupled means directly or indirectly connected for transmitting or conducting information, force, energy, or matter.

Optimizing: The terms "optimal," "optimizing," "optimize," "optimality," "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; 6) seeking to maximize one or more factors in light of competing and/or cooperative interests in maximizing, minimizing, or otherwise controlling one or more other factors, etc.

Order of steps: It should also be understood that, unless clearly indicated to the contrary, in any methods claimed herein that include more than one step or act, the order of the steps or acts of the method is not necessarily limited to the order in which the steps or acts of the method are recited.

Permeability: As used herein, the term "permeability" refers to the quantity of fluid, for example, hydrocarbons, that can flow through a rock as a function of time and pressure, related to how interconnected the pores are. Formation testing can directly measure a rock formation's permeability down a well. An estimate for permeability can be derived from empirical relationships with other measurements, including for example, temperature, pressure, and vibration measurements.

Petrophysics: As used herein, the term "petrophysics" refers to the study of physical and chemical rock properties and their interaction with fluids, including for example hydrocarbons.

Pitot array sensor: As used herein the term "pitot array sensor" refers to sensor two or more pitot-tubes each inserted at a different depth into a tubular about its circumference, in a single plane or staggered along the length of, for example, a production zone of a multi-zone production well. A plurality of pitot-tubes can include, but is not limited to, from 2 to 30 tubes, from 3 to 25 tubes, from 3 to 20 tubes, from 4 to 15 tubes, from 5 to 10 tubes, from 3 to 15 tubes, from 5 to 15 tubes, from 5 to 20 tubes, from 5 to 7 tubes, 3 tubes, 4 tubes, 5 tubes, 6 tubes, 7 tubes, 8 tubes, 9 tubes, 10 tubes, 11 tubes, 12 tubes, 13 tubes, 14 tubes, 15 tubes, 16 tubes, 17 tubes, 18 tubes, 19 tubes, or 20 pitot tubes. Each inserted pitot tube is in communication with a respective piezoelectric transducer provided on the outside of the tubular, e.g., clamped or otherwise attached, e.g., mechanically or chemically. The plurality of pitot tubes, each in communication with a respective piezoelectric transducer, is referred to herein as a "pitot array sensor."

Porosity: As used herein the term "porosity" refers to the percentage of a given volume of rock that is pore space and can therefore contain fluids. This can be determined using measurements from an instrument that measures the reaction of the rock to bombardment by neutrons or by gamma rays, or by sonic and NMR data.

Potting: As used herein, the term "potting" refers to the encapsulation of electrical components with epoxy, elastomeric, silicone, or asphaltic or similar compounds for the purpose of excluding moisture or vapors. Potted components may or may not be hermetically sealed.

Production fluids: As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

Production optimization: As used herein, the term "production optimization" refers to any method, device, control device, valve, chemical, metrics, data analysis, and/or system that can be used to improve hydrocarbon fluid production efficiency, hydrocarbon fluid production rates, hydrocarbon fluid recovery, produced gas/oil ratio, hydrocarbon fluid phase, utilization of the production plant to achieve higher throughput; water-cut, workovers, etc. Production optimization can be real-time production optimization including partial or complete automation, and/or optimization of control settings. Production optimization can be accomplished, for example, but not limited to, chemically by preventing or inhibiting scale, paraffin, asphaltene, and/or corrosion using inhibitors of one or more thereof; extending field life using for example, defoamers, emulsifiers, foamers, flow improvers, tracer dyes, and/or water clarifiers, acidizing, etc.; reinstating or improving flow performance chemically using, for example, dissolvers, cleaners, scavengers, adsorbents, water flooding, $CO_2$ flooding, etc.; mechanically, for example, but not limited to artificial lift, using, for example, pumps, including but not limited to, electric submersible pumps, gas lift, horizontal surface pumps, subsea lift systems, dewatering pump systems, geothermal pump systems, industrial pump systems, etc; gas/water injection optimization; tubing size optimization; perforation optimization; nitrogen circulation; and the like. In certain cases, production optimization may include sealing a lost circulation zone.

Production optimization can include, but is not limited to, one or more of the following: equalizing reservoir inflow along a length of the wellbore, partially choking flow, delaying water or gas breakthrough by reducing annular velocity across a selected interval, e.g., such as the heel of a horizontal well, adjusting flow from individual zones of a production well including one or more zones of a multi-zone production well, e.g., that are over- or under-pressured, slowing water and/or gas encroachment, and reducing the amount of bypassed reserves by equalizing a pressure drop along a length of a wellbore, e.g., so as to promote uniform flow of oil and gas through a formation so that the arrivals of water and gas are delayed and simultaneous. Production optimization can be accomplished using, for example, but not limited to, one or more of control devices including for example, ICDs including for example, one or more of passive ICDs, nozzle-based ICDs, orifice ICDs, channel ICDs, helical-channel ICDs, ResFlow ICDs, autonomous ICDs (AICDs), and ICDs that are tube-channel and orifice-nozzle combinations. ICDs suitable for use according to the presently described subject matter can include EQUIFLOW autonomous ICDs (Halliburton ICDs) can be used to manage fluid outflow in injection wells. ICDs can be placed both in injection and producer wells; or more remotely actuated downhole valves to shut off or reduce fluid flow from one or more well production zones; outflow control devices, valves and corresponding actuation devices, wellbore isolation devices including for example, tool seals, packers, cement plugs, bridge plugs, chemical control devices, and the like.

Production tubing: As used herein, the term "production tubing" refers to tubing that is run into a drilled well after the casing is run and cemented in place.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc., and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

References: In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

Reservoir formation model: As used herein, the term "reservoir model" refers to models that are built upon measured parameters and derived properties of the reservoir formation to estimate the amount of hydrocarbon present in the reservoir, the rate at which that hydrocarbon can be produced to the Earth's surface through wellbores, and the fluid flow in rocks.

Rock mechanical properties: As used herein, the term "rock mechanical properties" refers to strength and other mechanical properties of rock that can be determined, for example, using acoustic and density measurements of the rock. For example, compressive strength of rock can be determined by measuring compressional (P) wave velocity of sound through the rock and the shear (S) wave velocity together with the density of the rock. Compressive strength is the compressive stress that causes a rock to fail, and the rocks' flexibility, which is the relationship between stress and deformation for a rock. Converted-wave analysis can also be used to determine subsurface lithology and porosity.

Sealing material: As used herein, the term "sealing material" refers to any material that can seal a cover of a housing to a body of a housing sufficient to withstand one or more downhole conditions including but not limited to, for example, temperature, humidity, soil composition, corrosive elements, pH, and pressure.

Sensor: As used herein, the term "sensor" includes any electrical sensing device or gauge. The sensor may be capable of monitoring or detecting any reservoir formation parameter, including but not limited to, pressure, temperature, fluid flow, vibration, resistivity, impedance, attenuation, or other formation data. Such sensors can include but are not limited to a fluid velocity measurement device; a temperature sensor; a pressure sensor; a fluid density sensor; a microphone; an ultrasound sensor; a Doppler shift sensor; a chemical sensor; an imaging device; an impedance sensor; an attenuation sensor; a fluid resistivity sensor, and combinations thereof. Sensors may also include a position or location sensor.

Tubular member: The terms "tubular", "tubular member" or "tubular body" refer to any pipe, such as a joint of casing, a portion of a liner, a drill string, a production tubing, an injection tubing, a pup joint, a buried pipeline, underwater piping, or above-ground piping. Solid lines therein, and any suitable number of such structures and/or features may be omitted from a given embodiment without departing from the scope of the present disclosure. A "tubular body" may also include sand control screens, inflow control devices or valves, sliding sleeve joints, and pre-drilled or slotted liners.

Water saturation: As used herein, the term "water saturation" refers to the fraction of the pore space occupied by water. This is typically calculated rock resistivity measurements.

Wellbore: As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "zone" or "zone of interest" refer to a portion of a subsurface formation containing hydrocarbons. The term "hydrocarbon-bearing formation" may alternatively be used.

Description

Specific forms will now be described further by way of example. While the following examples demonstrate certain forms of the subject matter disclosed herein, they are not to be interpreted as limiting the scope thereof, but rather as contributing to a complete description.

The proposed invention identifies reservoir conditions and formation, for example, by using sensors including for example, permanent sensors, to detect and/or monitor reservoir conditions and properties along a wellbore. Permanent wireless sensor network nodes, powered by batteries or other power sources, are installed in the wellbore and are connected to different surveillance sensors. The monitoring data measured at each network sensor node are transmitted wirelessly from node to node to a receiver at the surface by one or more of acoustic waves, radio waves, low frequency or inductive electromagnetic waves, and light, providing real-time reservoir condition information.

Further, the wireless sensor network nodes, when combined with an optical or acoustic fiber of a distributed fiber system installed along the tubular body, may provide a useful, active acoustic testing system, in which one or more nodes could be selected as sound sources and used to generate acoustic pulses of selected frequencies and amplitude that propagate into reservoir formation. The acoustic fiber may be used as a distributed sound receiver system to receive the transmitted and reflected acoustic waves from the formation. This configuration effectively forms a seismic testing and data acquisition system that could be used to monitor and/or track changes of reservoir formation or tubular characteristics over time. The fiber measurement system could also be used in tandem with the node piezoelectric or other vibration receivers for purposes of acoustic system calibration, improved method and apparatus for identifying the specific location of receivers (fiber or node), and providing complementary acoustic frequency sensitivities to the optical fiber. The benefit of these improvements is enhanced reservoir information.

For existing wells where it is undesirable to pull out the production tubing, the wireless sensor nodes may be run into the hole on a tool string and mounted on the inside of the tubing or on the inside of side pocket mandrels. For newly-drilled wells, the network nodes may be installed as described above or may be installed on the outside of the production tubing before the tubing is run into the hole.

Figure 2:
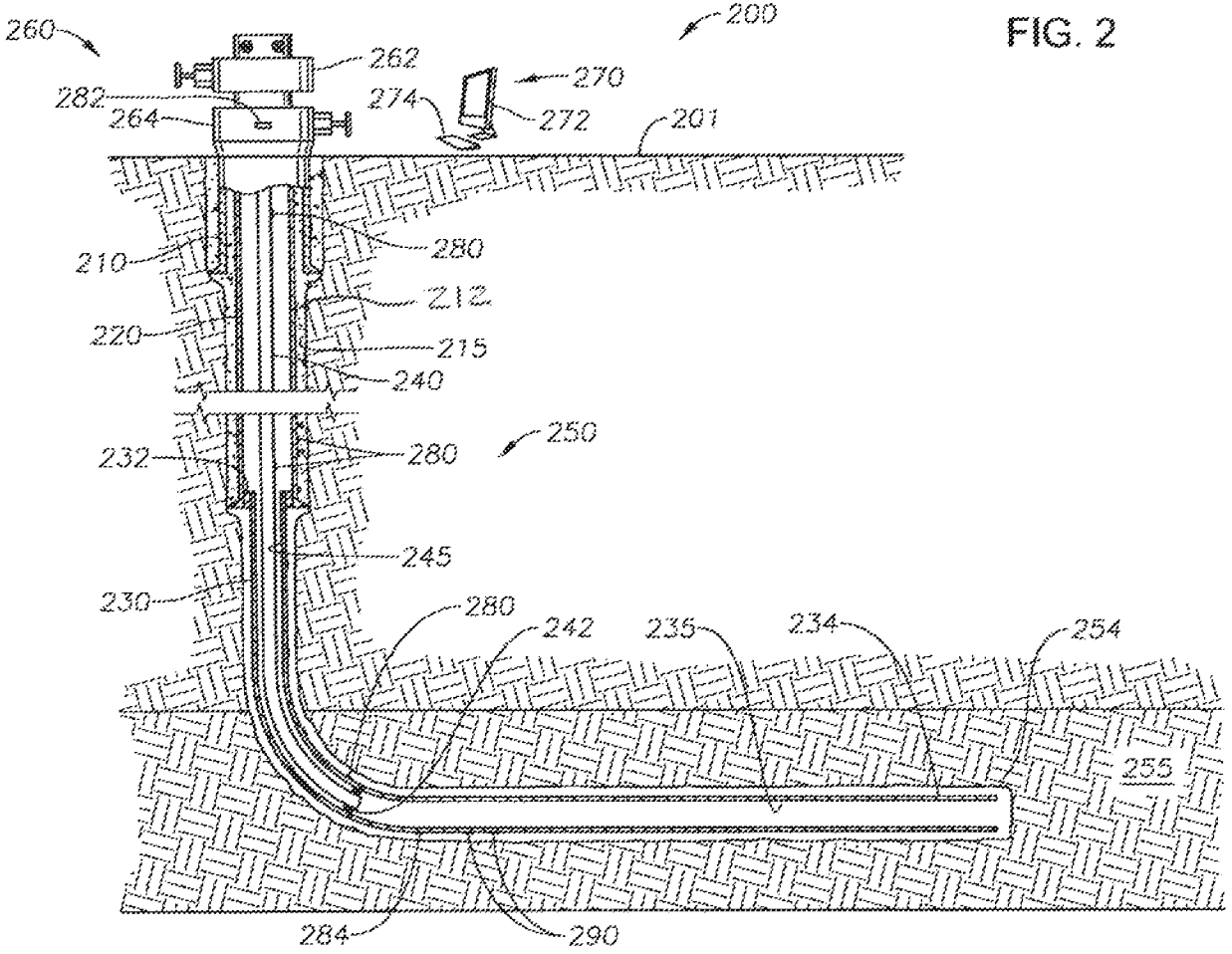
FIG. 2 presents a cross-sectional view of an illustrative, nonexclusive example of a wellbore having been completed. The illustrative wellbore has been completed as a cased hole completion. A series of communications nodes is placed along the casing string, as part of a telemetry system, according to the present disclosure.

FIGS. 1 and 2 present illustrative wellbores 150, 250 that may receive a downhole telemetry system using acoustic transducers. In each of FIGS. 1 and 2, the top of the drawing page is intended to be toward the surface and the bottom of the drawing page toward the well bottom. While wells commonly are completed in substantially vertical orientation, it is understood that wells may also be inclined and even horizontally completed. When the descriptive terms "up" and "down" or "upper" and "lower" or similar terms are used in reference to a drawing, they are intended to indicate location on the drawing page, and not necessarily orientation in the ground, as the present inventions have utility no matter how the wellbore is orientated.

FIG. 1 is a side, cross-sectional view of an illustrative well site 100. The well site 100 includes a derrick 120 at an earth surface 101. The well site 100 also includes a wellbore 150 extending from the earth surface 101 and down into an earth subsurface 155. The wellbore 150 is being formed using the derrick 120, a drill string 160 below the derrick 120, and a bottom hole assembly 170 at a lower end of the drill string 160.

Referring first to the derrick 120, the derrick 120 includes a frame structure 121 that extends up from the earth surface 101. The derrick 120 supports drilling equipment including a traveling block 122, a crown block 123 and a swivel 124. A so-called kelly 125 is attached to the swivel 124. The kelly 125 has a longitudinally extending bore (not shown) in fluid communication with a kelly hose 126. The kelly hose 126, also known as a mud hose, is a flexible, steel-reinforced, high-pressure hose that delivers drilling fluid through the bore of the kelly 125 and down into the drill string 160.

The kelly 125 includes a drive section 127. The drive section 127 is non-circular in cross-section and conforms to an opening 128 longitudinally extending through a kelly drive bushing 129. The kelly drive bushing 129 is part of a rotary table. The rotary table is a mechanically driven device that provides clockwise (as viewed from above) rotational force to the kelly 125 and connected drill string 160 to facilitate the process of drilling a borehole 105. Both linear and rotational movement may thus be imparted from the kelly 125 to the drill string 160.

A platform 102 is provided for the derrick 120. The platform 102 extends above the earth surface 101. The platform 102 generally supports rig hands along with various components of drilling equipment such as pumps, motors, gauges, a dope bucket, tongs, pipe lifting equipment and control equipment. The platform 102 also supports the rotary table.

It is understood that the platform 102 shown in FIG. 1 is somewhat schematic. It is also understood that the platform 102 is merely illustrative and that many designs for drilling rigs and platforms, both for onshore and for offshore operations, exist. These include, for example, top drive drilling systems. The claims provided herein are not limited by the configuration and features of the drilling rig unless expressly stated in the claims.

Placed below the platform 102 and the kelly drive section 127 but above the earth surface 101 is a blow-out preventer, or BOP 130. The BOP 130 is a large, specialized valve or set of valves used to control pressures during the drilling of oil and gas wells. Specifically, blowout preventers control the fluctuating pressures emanating from subterranean formations during a drilling process. The BOP 130 may include upper 132 and lower 134 rams used to isolate flow on the back side of the drill string 160. Blowout preventers 130 also prevent the pipe joints making up the drill string 160 and the drilling fluid from being blown out of the wellbore 150 in the event of a sudden pressure kick.

As shown in FIG. 1, the wellbore 150 is being formed down into the subsurface formation 155. In addition, the wellbore 150 is being shown as a deviated wellbore. Of course, this is merely illustrative as the wellbore 150 may be a vertical well or even a horizontal well, as shown later in FIG. 2.

In drilling the wellbore 150, a first string of casing 110 is placed down from the surface 101. This is known as surface casing 110 or, in some instances (particularly offshore), conductor pipe. The surface casing 110 is secured within the formation 155 by a cement sheath 112. The cement sheath 112 resides within an annular region 115 between the surface casing 110 and the surrounding formation 155.

During the process of drilling and completing the wellbore 150, additional strings of casing (not shown) will be provided. These may include intermediate casing strings and a final production casing string. For an intermediate case string or the final production casing, a liner may be employed, that is, a string of casing that is not tied back to the surface 101.

As noted, the wellbore 150 is formed by using a bottom hole assembly 170. The bottom-hole assembly 170 allows the operator to control or "steer" the direction or orientation of the wellbore 150 as it is formed. In this instance, the bottom hole assembly 170 is known as a rotary steerable drilling system, or RSS.

The bottom hole assembly 170 will include a drill bit 172. The drill bit 172 may be turned by rotating the drill string 160 from the platform 102. Alternatively, the drill bit 172 may be turned by using so-called mud motors 174. The mud motors 174 are mechanically coupled to and turn the nearby drill bit 172. The mud motors 174 are used with stabilizers or bent subs 176 to impart an angular deviation to the drill bit 172. This, in turn, deviates the well from its previous path in the desired azimuth and inclination.

There are several advantages to directional drilling. These primarily include the ability to complete a wellbore along a substantially horizontal axis of a subsurface formation, thereby exposing a greater formation face. These also include the ability to penetrate into subsurface formations that are not located directly below the wellhead. This is particularly beneficial where an oil reservoir is located under an urban area or under a large body of water. Another benefit of directional drilling is the ability to group multiple wellheads on a single platform, such as for offshore drilling. Finally, directional drilling enables multiple laterals and/or sidetracks to be drilled from a single wellbore in order to maximize reservoir exposure and recovery of hydrocarbons.

The illustrative well site 100 also includes a sensor 178. In some embodiments, the sensor 178 is part of the bottom hole assembly 170. The sensor 178 may be, for example, a set of position sensors that is part of the electronics for an RSS. Alternatively or in addition, the sensor 178 may be a temperature sensor, a pressure sensor, or other sensor for detecting a downhole condition during drilling. Alternatively still, the sensor may be an induction log or gamma ray log or other log that detects fluid and/or geology downhole.

The sensor 178 may be part of a measurement while drilling (MWD) or a logging while drilling (LWD) assembly. It is observed that the sensor 178 is located above the mud motors 174. This is a common practice for MWD assemblies. This allows the electronic components of the sensor 178 to be spaced apart from the high vibration and centrifugal forces acting on the bit 172.

Where the sensor 178 is a set of position sensors, the sensors may include three inclinometer sensors and three environmental acceleration sensors. Ideally, a temperature sensor and a wear sensor will also be placed in the drill bit 172. These signals are input into a multiplexer and transmitted.

As the wellbore 150 is being formed, the operator may wish to evaluate the integrity of the cement sheath 112 placed around the surface casing 110 (or other casing string). To do this, the industry has relied upon so-called cement bond logs. A cement bond log (or CBL), uses an acoustic signal that is transmitted by a logging tool at the end of a wireline. The logging tool includes a transmitter, and one or more receivers that "listen" for sound waves generated by the transmitter through the surrounding casing string. The logging tool includes a signal processor that takes a continuous measurement of the amplitude of sound pulses from the transmitter to the receiver. Alternately, the attenuation of the sonic signal may be measured.

In some instances, a bond log will measure acoustic impedance of the material in the annulus directly behind the casing. This may be done through resonant frequency decay. Such logs include, for example, the USIT log of Schlumberger (of Sugar Land, Tex.) and the CAST-V log of Halliburton (of Houston, Tex.).

It is desirable to implement a downhole telemetry system that enables the operator to evaluate cement sheath integrity without need of running a CBL line. This enables the operator to check cement sheath integrity as soon as the cement has set in the annular region 115 or as soon as the wellbore 150 is completed. Additionally or alternatively, one or more sensors (not shown) may be deployed downhole to monitor a wide variety of properties, including, but not limited to, fluid characteristics, temperature, depth, etc., as those skilled in the art will plainly understand.

To do this, the well site 100 includes a plurality of battery-powered intermediate communications nodes 180. The battery-powered intermediate communications nodes 180 are placed along the outer surface of the surface casing 110 according to a pre-designated spacing. The battery-powered intermediate communications nodes 180 are configured to receive and then relay acoustic signals along the length of the wellbore 150 in node-to-node arrangement up to the topside communications node 182. The topside communications node 182 is placed closest to the surface 101. The topside communications node 182 is configured to receive acoustic signals and convert them to electrical or optical signals. The topside communications node 182 may be above grade or below grade.

The nodes may also include a sensor communications node 184. The sensor communications node is placed closest to the sensor 178. The sensor communications node 184 is configured to communicate with the downhole sensor 178, and then send a wireless signal using an acoustic wave.

As indicated, the intermediate communications nodes 180 of the downhole telemetry system are powered by batteries and, as such, system energy limitations can be encountered. While the useful life of the network can be extended by placing the nodes into a "deep sleep" mode when data collection and communication are not needed; heretofore, there have been no methods available to awaken the intermediate communications nodes 180 when data acquisition is required. Thus, prior to the systems and methods of the present disclosure, the downhole telemetry system was always in the active state; consequently, the life of the network was limited to months, not years.

In operation, the sensor communications node 184 is in electrical communication with the sensor 178. This may be by means of a short wire, or by means of wireless communication such as infrared or radio-frequency communication. The sensor communications node 184 is configured to receive signals from the sensor 178, wherein the signals represent a subsurface condition such as position, temperature, pressure, resistivity, or other formation data. The sensor can be contained in the same housing as the sensor communications node 184. Indeed, the sensor may be the same electro-acoustic transducer that enables the telemetry communication.

The sensor communications node 184 transmits signals from the sensor 178 as acoustic waves. The acoustic waves can be at a frequency of between about 50 kHz and 500 kHz, from about 50 kHz to about 300 kHz, from about 60 kHz to about 200 kHz, from about 65 kHz to about 175 kHz, from about 70 kHz to about 160 kHz, from about 75 kHz to about 150 kHz, from about 80 kHz to about 140 kHz, from about 85 kHz to about 135 kHz, from about 90 kHz to about 130 kHz, or from about 100 kHz to about 125 kHz. The signals are received by an intermediate communications node 180 that is closest to the sensor communications node 184. That intermediate communications node 180, in turn, will relay the signal on to a next-closest node 180 so that acoustic waves indicative of the downhole condition are sent from node-to-node. A last intermediate communications node 180 transmits the signals acoustically to the topside communications node 182.

Communication may be between adjacent nodes, or it may occasionally skip a node depending on node spacing or communication range. Communication can be routed around any nodes that are broken. The number of nodes which transmit a communication packet is fewer than the total number of nodes between the sensor node and the topside node in order to conserve battery power and extend the operational life of the network.

The well site 100 of FIG. 1 also shows a receiver 190. The receiver 190 comprises a processor 192 that receives signals sent from the topside communications node 182. The signals may be received through a wire (not shown) such as a co-axial cable, a fiber optic cable, a USB cable, or other electrical or optical communications wire. Alternatively, the receiver 190 may receive signals from the topside communications node 182 wirelessly through a modem, a transceiver or other wireless communications link. The receiver 190 can receive electrical signals via a so-called Class I, Division 1 conduit, that is, a housing for wiring that is considered acceptably safe in an explosive environment. In some applications, radio, infrared or microwave signals may be utilized.

The processor 192 may include discrete logic, any of various integrated circuit logic types, or a microprocessor. In any event, the processor 192 may be incorporated into a computer having a screen. The computer may have a separate keyboard 194, as is typical for a desk-top computer, or an integral keyboard as is typical for a laptop or a personal digital assistant. The receiver 190 may also be an embedded controller with neither a screen nor a keyboard which communicates with a remote computer such as via wireless, cellular modem, or telephone lines. In one aspect, the processor 192 is part of a multi-purpose "smart phone" having specific "apps" and wireless connectivity.

It is noted that data may be sent along the nodes not only from the sensor 178 up to the receiver 190, but also from the receiver 190 down to the sensor 178. This transmission may be of benefit in the event that the operator wishes to make a change in the way the sensor 178 is functioning. This is also of benefit when the sensor 178 is actually another type of device, such as an inflow control device that opens, closes or otherwise actuates in response to a signal from the surface 101.

FIG. 1 illustrates the use of a wireless data telemetry system during a drilling operation. As may be appreciated, the wireless downhole telemetry system may also be employed after a well is completed.

FIG. 2 is a cross-sectional view of an illustrative well site 200. The well site 200 includes a wellbore 250 that penetrates into a subsurface formation 255. The wellbore 250 has been completed as a cased-hole completion for producing hydrocarbon fluids. The well site 200 also includes a well head 260. The well head 260 is positioned at an earth surface 201 to control and direct the flow of formation fluids from the subsurface formation 255 to the surface 201.

Referring first to the well head 260, the well head 260 may be any arrangement of pipes or valves that receive reservoir fluids at the top of the well. In the arrangement of FIG. 2, the well head 260 represents a so-called Christmas tree. A Christmas tree is typically used when the subsurface formation 255 has enough in situ pressure to drive production fluids from the formation 255, up the wellbore 250, and to the surface 201. The illustrative well head 260 includes a top valve 262 and a bottom valve 264.

It is understood that rather than using a Christmas tree, the well head 260 may alternatively include a motor (or prime mover) at the surface 201 that drives a pump. The pump, in turn, reciprocates a set of sucker rods and a connected positive displacement pump (not shown) downhole. The pump may be, for example, a rocking beam unit or a hydraulic piston pumping unit. Alternatively still, the well head 260 may be configured to support a string of production tubing having a downhole electric submersible pump, a gas lift valve, or other means of artificial lift (not shown). The present inventions are not limited by the configuration of operating equipment at the surface unless expressly noted in the claims.

Referring next to the wellbore 250, the wellbore 250 has been completed with a series of pipe strings referred to as casing. First, a string of surface casing 210 has been cemented into the formation. Cement is shown in an annular bore 215 of the wellbore 250 around the casing 210. The cement is in the form of an annular sheath 212. The surface casing 210 has an upper end in sealed connection with the lower valve 264.

Next, at least one intermediate string of casing 220 is cemented into the wellbore 250. The intermediate string of casing 220 is in sealed fluid communication with the upper master valve 262. A cement sheath 212 is again shown in a bore 215 of the wellbore 250. The combination of the casing 210/220 and the cement sheath 212 in the bore 215 strengthens the wellbore 250 and facilitates the isolation of formations behind the casing 210/220.

It is understood that a wellbore 250 may, and typically will, include more than one string of intermediate casing. In some instances, an intermediate string of casing may be a liner.

Finally, a production string 230 is provided. The production string 230 is hung from the intermediate casing string 220 using a liner hanger 232. The production string 230 is a liner that is not tied back to the surface 101. In the arrangement of FIG. 2, a cement sheath 232 is provided around the liner 230.

The production liner 230 has a lower end 234 that extends to an end 254 of the wellbore 250. For this reason, the wellbore 250 is said to be completed as a cased-hole well. Those of ordinary skill in the art will understand that for production purposes, the liner 230 may be perforated after cementing to create fluid communication between a bore 235 of the liner 230 and the surrounding rock matrix making up the subsurface formation 255. In one aspect, the production string 230 is not a liner but is a casing string that extends back to the surface.

As an alternative, end 254 of the wellbore 250 may include joints of sand screen (not shown). The use of sand screens with gravel packs allows for greater fluid communication between the bore 235 of the liner 230 and the surrounding rock matrix while still providing support for the wellbore 250. In this instance, the wellbore 250 would include a slotted base pipe as part of the sand screen joints. Of course, the sand screen joints would not be cemented into place and would not include subsurface communications nodes.

The wellbore 250 optionally also includes a string of production tubing 240. The production tubing 240 extends from the well head 260 down to the subsurface formation 255. In the arrangement of FIG. 2, the production tubing 240 terminates proximate an upper end of the subsurface formation 255. A production packer 242 is provided at a lower end of the production tubing 240 to seal off an annular region 245 between the tubing 240 and the surrounding production liner 230. However, the production tubing 240 may extend closer to the end 234 of the liner 230.

In some completions a production tubing 240 is not employed. This may occur, for example, when a monobore is in place.

It is also noted that the bottom end 234 of the production string 230 is completed substantially horizontally within the subsurface formation 255. This is a common orientation for wells that are completed in so-called "tight" or "unconventional" formations. Horizontal completions not only dramatically increase exposure of the wellbore to the producing rock face, but also enable the operator to create fractures that are substantially transverse to the direction of the wellbore. Those of ordinary skill in the art may understand that a rock matrix will generally "part" in a direction that is perpendicular to the direction of least principal stress. For deeper wells, that direction is typically substantially vertical. However, the present inventions have equal utility in vertically completed wells or in multi-lateral deviated wells.

As with the well site 100 of FIG. 1, the well site 200 of FIG. 2 includes a telemetry system that utilizes a series of novel communications nodes. This again is for the purpose of evaluating the integrity of the cement sheath 212, 232. The communications nodes are placed along the outer diameter of the casing strings 210, 220, 230. These nodes allow for the high speed transmission of wireless signals based on the in situ generation of acoustic waves.

The nodes first include a topside communications node 282. The topside communications node 282 is placed closest to the surface 201. The topside node 282 is configured to receive and/or transmit signals. The topside communications node 282 should be placed on the wellhead or next to the surface along the uppermost joint of casing 210.

The nodes also include a sensor communications node 284. The sensor communications node 284 is placed closest to the sensors 290. The sensor communications node 284 is configured to communicate with the downhole sensor 290, and then send a wireless signal using acoustic waves.

Finally, the nodes include a plurality of intermediate communications nodes 280. Each of the intermediate communications nodes 280 resides between the sensor communications node 284 and the topside communications node 282. The intermediate communications nodes 280 are configured to receive and then relay acoustic signals along the length of the tubing string 240. The intermediate nodes 280 can utilize two-way electro-acoustic transducers to receive and relay mechanical waves. The intermediate communications nodes 280 can reside along an outer diameter of the casing strings no, 220, 230.

The sensors 290 are placed at the depth of the subsurface formation 255. The sensors 290 may be, for example, pressure sensors, flow meters, or temperature sensors. A pressure sensor may be, for example, a sapphire gauge or a quartz gauge. Sapphire gauges can be used as they are considered more rugged for the high-temperature downhole environment. Alternatively, the sensors may be microphones for detecting ambient noise, or geophones (such as a tri-axial geophone) for detecting the presence of micro-seismic activity. Alternatively still, the sensors may be fluid flow measurement devices such as a spinners, or fluid composition sensors.

The sensor communications node 284 transmits signals from the sensors 290 as acoustic waves. The acoustic waves can be at a frequency band of about 50 kHz and 500 kHz, from about 50 kHz to about 300 kHz, from about 60 kHz to about 200 kHz, from about 65 kHz to about 175 kHz, from about 70 kHz to about 160 kHz, from about 75 kHz to about 150 kHz, from about 80 kHz to about 140 kHz, from about 85 kHz to about 135 kHz, from about 90 kHz to about 130 kHz, or from about 100 kHz to about 125 kHz, or about 100 kHz. The signals are received by the intermediate communications nodes 280. That intermediate communications nodes 280, in turn, will relay the signal on to another intermediate communications node so that acoustic waves indicative of the downhole condition are sent from node-to-node. A last intermediate communications node 280 transmits the signals to the topside node 282.

In operation, the sensor communications node 284 is in electrical communication with the (one or more) sensors 290. This may be by means of a short wire, or by means of wireless communication such as infrared or radio waves. The sensor communications node 284 is configured to receive signals from the sensors 290, wherein the signals represent a subsurface condition such as temperature or pressure. Alternatively, sensor 290 may be contained in the housing of communications node 284.

The subsurface battery-powered intermediate communications nodes 280 transmit signals as acoustic waves. The acoustic waves can be at a frequency of, for example, between about 50 kHz and 500 kHz, from about 50 kHz to about 300 kHz, from about 60 kHz to about 200 kHz, from about 65 kHz to about 175 kHz, from about 70 kHz to about 160 kHz, from about 75 kHz to about 150 kHz, from about 80 kHz to about 140 kHz, from about 85 kHz to about 135 kHz, from about 90 kHz to about 130 kHz, or from about 100 kHz to about 125 kHz. The signals are delivered up to the topside communications node 282, in node-to-node arrangement. The signals are delivered up to the topside communications node 282 so that signals indicative of cement integrity are sent from node-to-node. A last subsurface battery-powered intermediate communications node 280 transmits the signals acoustically to the topside communications node 282. Communication may be between adjacent nodes or may skip nodes depending on node spacing or communication range. Communication can be routed around nodes which are not functioning properly.

The well site 200 of FIG. 2 shows a receiver 270. The receiver 270 can comprise a processor 272 that receives signals sent from the topside communications node 282. The processor 272 may include discreet logic, any of various integrated circuit logic types, or a microprocessor. The receiver 270 may include a screen and a keyboard 274 (either as a keypad or as part of a touch screen). The receiver 270 may also be an embedded controller with neither a screen nor a keyboard which communicates with a remote computer such as via wireless, cellular modem, or telephone lines. In one aspect, the processor 272 is part of a multipurpose "smart phone" having specific "apps" and wireless connectivity.

The signals may be received by the processor 272 through a wire (not shown) such as a co-axial cable, a fiber optic cable, a USB cable, or other electrical or optical communications wire. Alternatively, the receiver 270 may receive the final signals from the topside node 282 wirelessly through a modem or transceiver. The receiver 270 can receive electrical signals via a so-called Class I, Div. 1 conduit, that is, a wiring system or circuitry that is considered acceptably safe in an explosive environment. In each of FIGS. 1 and 2, the battery-powered intermediate communications nodes 180, 280 are specially designed to withstand the same corrosive and environmental conditions (for example, high temperature, high pressure) of a wellbore 150 or 250, as the casing strings, drill string, or production tubing. To do so, the battery-powered intermediate communications nodes 180, 280 can include sealed steel housings for holding the electronics. In one aspect, the steel material is a corrosion resistant alloy.

As with the embodiment of FIG. 1, the intermediate communications nodes 280 of the downhole telemetry system are powered by batteries and, as such, system energy limitations can be encountered. While the useful life of the network can be extended by placing the nodes into a "deep sleep" mode when data collection and communication are not needed; heretofore, there have been no methods available to awaken the intermediate communications nodes 280 when data acquisition is required. Thus, prior to the systems and methods of the present disclosure, the downhole telemetry system was always in the active state; consequently, the life of the network was limited to months, not years.

Figure 3:
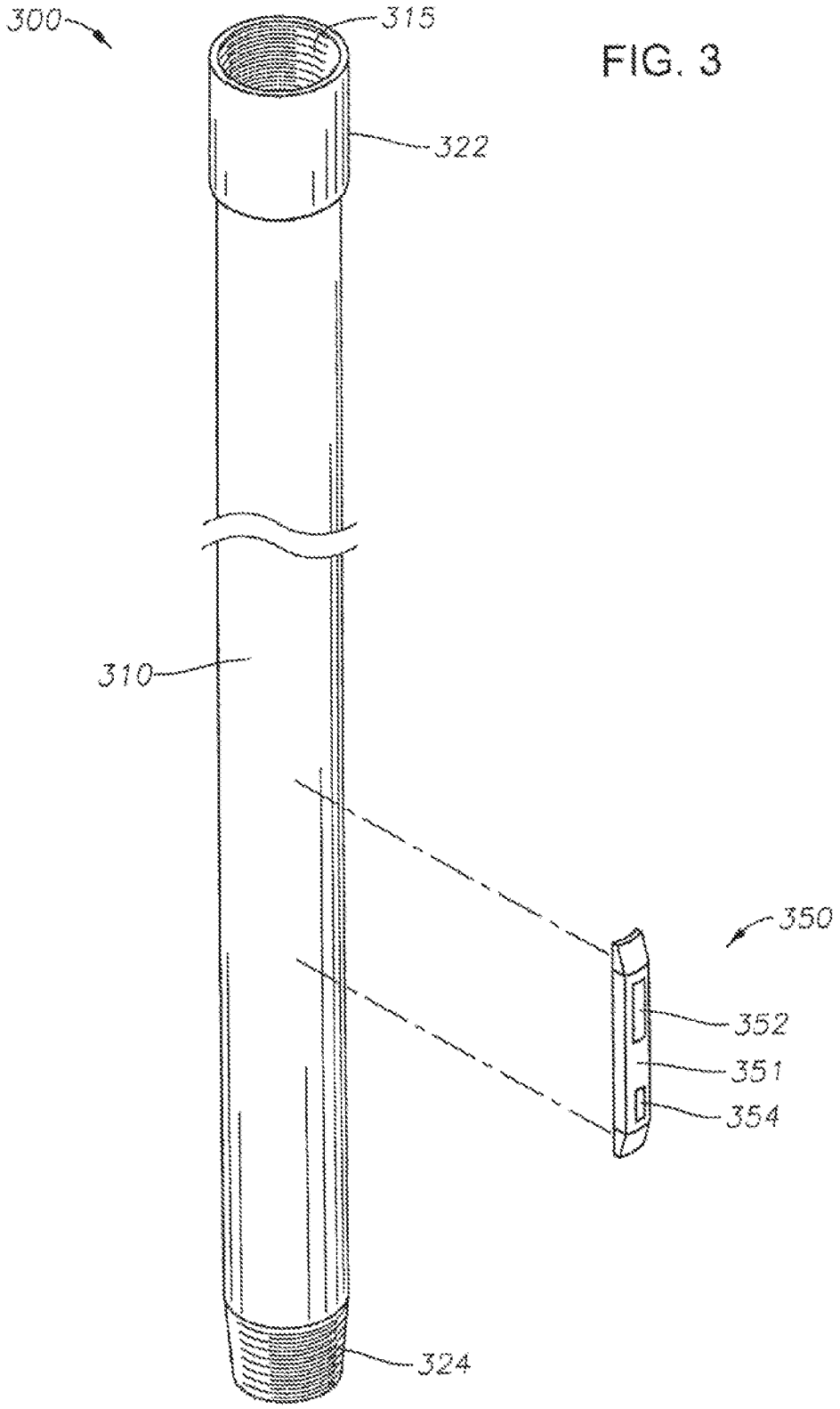
FIG. 3 is a perspective view of an illustrative, nonexclusive example of a wellbore tubular joint, with a communications node of one aspect of the presently described subject matter shown exploded away from the casing joint.

In FIG. 3, tubular 300 is intended to represent any tubular body such as a pipe joint, joint of tubing, a casing, or a portion of pipeline. The tubular 300 has an elongated wall 310 defining an internal bore 315. The bore 315 can transmit drilling fluids such as an oil based mud, or OBM, during a drilling operation. The tubular 300 has a box end 322 having internal threads, and a pin end 324 having external threads.

As noted, an illustrative intermediate communications node 350 is shown exploded away from the tubular body 300. The communications node 350 is designed to attach to the wall 310 of the tubular body 300 at a selected location. In one aspect, selected tubulars, including for example, pipe joints, 300 will each have an intermediate communications node 350 between the box end 322 and the pin end 324. In one arrangement, the communications node 350 is placed immediately adjacent the box end 322 or, alternatively, immediately adjacent the pin end 324 of, for example, every joint of pipe. In another arrangement, the communications node 350 is placed at a selected location along a tubular 300, for example, every second or every third pipe joint in a drill string 160. In other aspects, more or less than one intermediate communications node may be placed per joint.

The intermediate communications node 350 shown in FIG. 3 is designed to be, for example, pre-welded onto the wall 310 of the tubular 300. However, the communications node 350 can be configured to be selectively attachable to/detachable from a tubular 300 by mechanical means at a well site. This may be done, for example, through the use of clamps. Alternatively, an epoxy may be used for chemical bonding. In any instance, the communications node 350 can be an independent wireless communications device that is designed to be attached to a surface, for example an external or internal surface, of a tubular, including for example, a well pipe.

There are several benefits to the use of an externally-placed communications node that uses acoustic waves. For example, such a node will not interfere with the flow of fluids within the internal bore 315 of the tubular 300. Further, installation and mechanical attachment can be readily assessed or adjusted, as necessary.

Figure 4A:
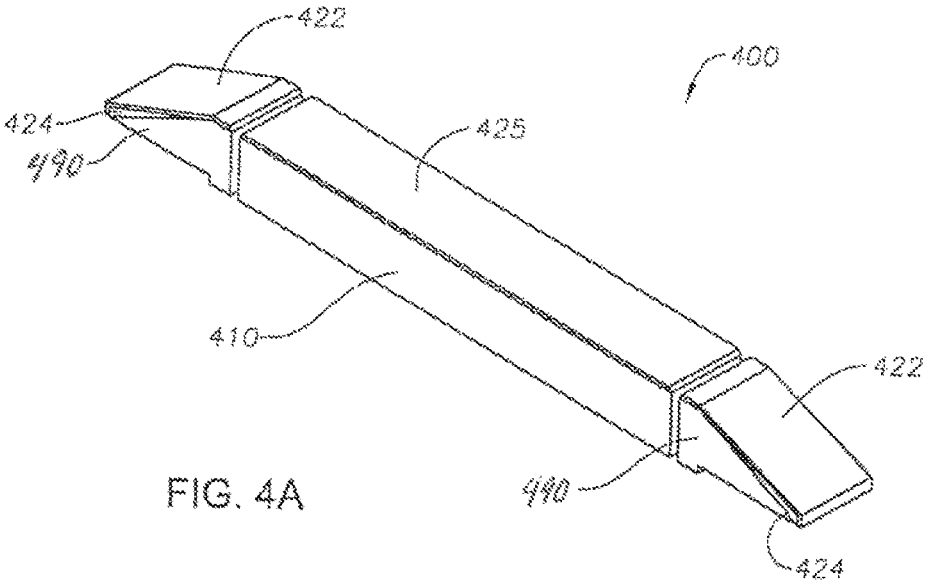
FIG. 4A is a perspective view of a communications node as may be used in the wireless data transmission system of the presently described subject matter, in an alternate embodiment.
Figure 4B:
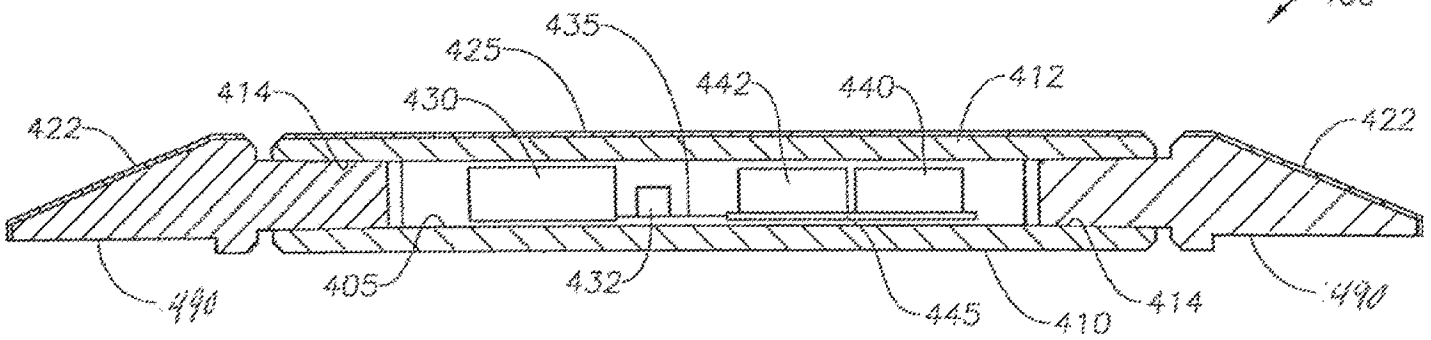
FIG. 4B is a cross-sectional view of the communications node of FIG. 4A taken along the longitudinal axis of the node, including a sensor provided within the communications node.

In FIG. 3, the intermediate communications node 350 includes an elongated housing 351. The housing 351 supports one or more batteries, shown schematically at 352. The housing 351 also supports an electro-acoustic transducer, shown schematically at 354. For example, the electro-acoustic transducer 354 may be a two-way transceiver that can both receive and transmit acoustic signals. The communications node 350 is intended to represent the communications nodes 180 of FIG. 1, in one aspect. The two-way electro-acoustic transducer 354 in each node 180 allows acoustic signals to be sent from node-to-node, either up the wellbore 150 or down the wellbore 150. Where the tubular 300 is formed of carbon steel, such as a casing or liner, the housing 351 may be fabricated from carbon steel. This metallurgical match avoids galvanic corrosion at the coupling. FIG. 4A is a perspective view of a communications node 400 as may be used in the wireless data transmission systems of FIG. 1 or FIG. 2 (or other wellbore), in one embodiment. The communications node 400 may be an intermediate communications node that is designed to provide two-way communication using a transceiver within a novel downhole housing assembly. FIG. 4B is a cross-sectional view of the communications node 400 of FIG. 4A. The view is taken along the longitudinal axis of the node 400. The communications node 400 will be discussed with reference to FIGS. 4A to 4C, together.

The communications node 400 first includes a housing 410. The housing 410 is designed to be attached to a wall of a tubular, including for example, an outer wall of a tubular, e.g., a casing and/or a joint of wellbore pipe. Where the wellbore pipe is a carbon steel pipe joint such as drill pipe, casing or liner, the housing can be fabricated from, for example, carbon steel. This metallurgical match avoids galvanic corrosion at the coupling.

The housing 410 is dimensioned to be strong enough to protect internal electronics. In one aspect, the housing 410 has an outer wall 412 that is about 0.2 inches (0.51 cm) in thickness. A bore 405 is formed within the wall 412. The bore 405 houses the electronics, shown in FIG. 4B as a battery 430, a power supply wire 435, a transceiver 440, and a circuit board 445. The circuit board 445 can include a micro-processor or electronics module that processes acoustic signals. An electro-acoustic transducer 442 is provided to convert acoustical energy to electrical energy (or vice-versa) and is coupled, for example, with outer wall 412 on the side attached to the tubular body. The transducer 442 is in electrical communication with at least one sensor 432.

It is noted that in FIG. 4B, the sensor 432 resides within the housing 410 of the communications node 400. However, as noted, the sensor 432 may reside external to the communications node 400, such as above or below the node 400 along the wellbore.

Figure 4C:
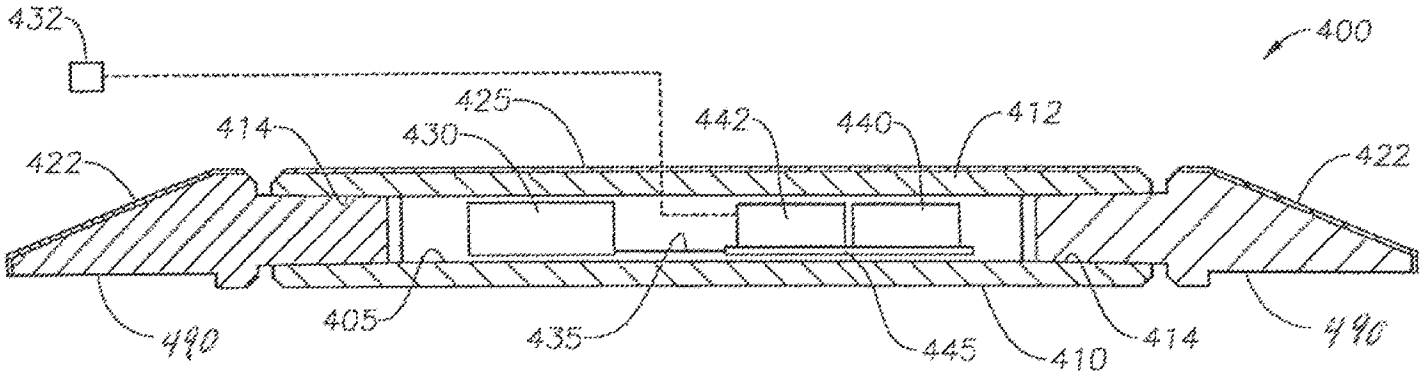
FIG. 4C is another cross-sectional view of the communications node of FIG. 4A taken along the longitudinal axis of the node, and a sensor resides along the wellbore external to the communications node.

In FIG. 4C, a dashed line is provided showing an extended connection between the sensor 432 and the electro-acoustic transducer 442. The transceiver 440 will receive an acoustic telemetry signal. In one aspect, the acoustic telemetry data transfer is accomplished using multiple frequency shift keying (MFSK). Any extraneous noise in the signal is moderated by using well-known conventional analog and/or digital signal processing methods. This noise removal and signal enhancement may involve conveying the acoustic signal through a signal conditioning circuit using, for example, a bandpass filter.

The transceiver will also produce acoustic telemetry signals. In one aspect, an electrical signal is delivered to an electromechanical transducer, such as through a driver circuit. The transducer can be the same electro-acoustic transducer that originally received the MFSK data. The signal generated by the electro-acoustic transducer then passes through the housing 410 to the tubular body (such as production tubing 240), and propagates along the tubular body to other communication nodes. The re-transmitted signal represents the same sensor data originally transmitted by sensor communications node 284. In one aspect, the acoustic signal is generated and received by a magnetostrictive transducer comprising a coil wrapped around a core as the transceiver. In another aspect, the acoustic signal is generated and received by a piezo-electric ceramic transducer. In either case, the electrically encoded data are transformed into a sonic wave that is carried through the wall of the tubular body in the wellbore.

The piezoelectric transmitter can comprise multiple piezoelectric disks, each piezoelectric disk having at least a pair of electrodes connected in series with an adjacent piezoelectric disk. A single voltage is applied equally to each piezoelectric disk, and the mechanical output of the piezoelectric transmitter is increased by increasing the number of disks while applying the same voltage.

The piezoelectric receiver can comprise multiple piezoelectric disks, each piezoelectric disk having at least a pair of electrodes connected in series with an adjacent piezoelectric disk, such as wherein the piezoelectric receiver comprises a single piezoelectric disk, the single piezoelectric disk having a thickness equivalent to the total thickness of a multiple piezoelectric disk.

The communications node 400 optionally has a protective outer layer 425. The protective outer layer 425 resides external to the wall 412 and provides an additional thin layer of protection for the electronics. The communications node 400 can also be fluid sealed with the housing 410 to protect the internal electronics. Additional protection for the internal electronics is available using an optional potting material.

The communications node 400 also optionally includes a shoe 490. More specifically, the node 400 includes a pair of shoes 490 disposed at opposing ends of the wall 412. Each of the shoes 490 provides a beveled face that helps prevent the node 400 from hanging up on an external tubular body or the surrounding earth formation, as the case may be, during run-in or pull-out. The shoes 490 may have a protective outer layer 422 and an optional cushioning material 424 (shown in FIG. 4A) under the outer layer 422.

In one arrangement, the communications nodes 400 with the shoes 490 can be welded onto an inner or outer surface of the tubular body, such as wall 310 of the tubular 300. More specifically, the body 410 of the respective communications nodes 400 is welded onto the wall of the tubular body. In some cases, it may not be feasible or desirable to pre-weld the communications nodes 400 onto pipe joints before delivery to a well site. Therefore, it is desirable to utilize a clamping system that allows a drilling or service company to mechanically connect/disconnect the communications nodes 400 along a tubular body as the tubular body is being run into a wellbore.

Figure 5A:
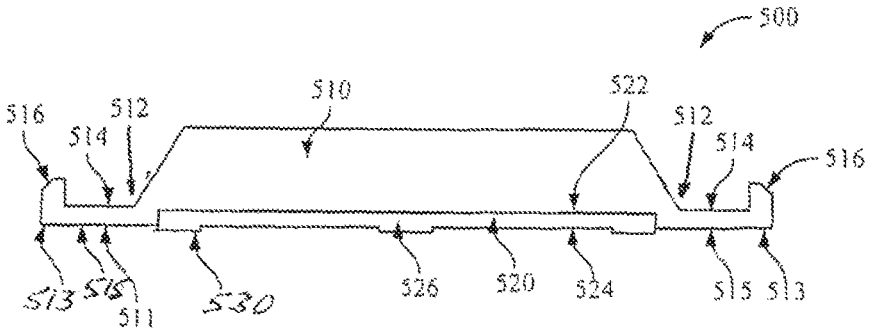
FIG. 5A presents a side view of an illustrative, nonexclusive example of an alternative communications node.

FIG. 5A is a side view of an illustrative, nonexclusive example of a communications node 500 as may be used in the wireless data transmission systems of FIG. 1 or 2 (or other wellbore), in one aspect. The communications node 500 may be an intermediate communications node that is designed to provide two-way communication using a transceiver within a novel downhole housing assembly. Communications node 500 includes body 510 and a cover 520. The body 510 includes an interior portion configured to receive an electrical component, and has a body length, a body width, and a body depth. The body 510 also includes a first chamfered perimeter (not shown) defining an open top portion. The body 510 includes a pair of opposing lengthwise tabs 511 each extending from a linear end of the body 512 adjacent to the open top portion, each of the lengthwise tabs 511 having a tab length, a tab thickness less than the depth of the body, a tab terminal end 513, and a first tab surface 514 and an opposing second tab surface 515. The lengthwise tabs may further comprise a tab terminal projection 516 extending from the first tab surface 514 at the terminal end 513.

Cover 520 of FIG. 5A has a cover length, a cover width, and a cover thickness, the cover being configured to cover the open top portion of body 510 and enclose the interior portion of body 510. The cover 520 includes a first surface 522 and an opposing second surface 524. The first surface 522 can comprise a second chamfered perimeter configured to sealingly engage with the first chamfered perimeter of body 510.

The opposing second surface 524 of cover 520 can include at least one integral engagement portion 526 projecting from the opposing second surface and having an engagement surface and an engagement length where the engagement length is less than or equal to a cover length. For example, the engagement length of each at least one integral engagement portions 526 can be equal to or substantially equal to the cover length, or can be from about 2% to about 98%, from about 5% to about 90%, from about 10% to about 80%, from about 15% to about 75%, from about 20% to about 70%, from about 25% to about 65%, from about 30% to about 60%, from about 35% to about 55%, from about 40% to about 50%, from about 2% to about 35%, from about 4% to about 30%, from about 6% to about 25%, from about 7% to about 20%, from about 8% to about 15%, about 9%, about 10% about 11%, about 12% about 13%, about 14%, or about 15% of the cover length. The engagement length of each of two or more engagement portions 526, can be the same or different. When communications node 500 is attached to an outer surface of a tubular, only engagement surface 530 of the at least one integral engagement portion 526 is in contact with the outer surface of the tubular. The entire engagement surface 530 or a portion of the engagement surface 530 may be in contact with an outer surface of the tubular.

The body 510 and the cover 520 including one or more electrical components, are sealed via the second chamfered perimeter of the cover 520 configured to sealingly engage with the first chamfered perimeter of body 510 and a sealing material for sealing the cover to the body via said first chamfered perimeter and the second chamfered perimeter. The sealing material can be a chemical bonding material, for example, including but not limited to, an epoxy. The first chamfered perimeter and the second chamfered perimeter can be of any configuration and can include a configuration that upon engagement with each other, a space is created defined by the first chamfered perimeter and the second chamfered perimeter, whereby upon sealing with a sealing material, the sealing material fills the space resulting in an improved seal.

Figure 5B:
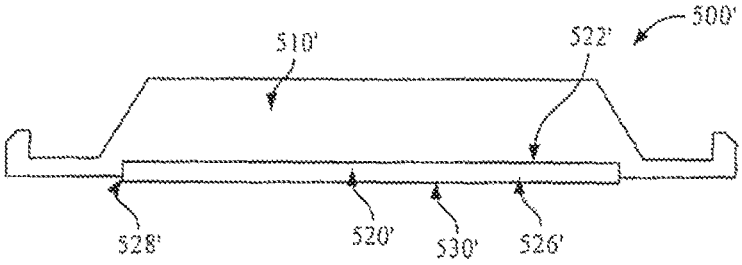
FIG. 5B presents a side view of an additional illustrative, nonexclusive example of a communications node, according to the present disclosure.

FIG. 5B is a side view of another illustrative, nonexclusive example of a communications node, i.e., communications node 500' including body 510' and a cover 520'. Cover 520' includes a single integral engagement portion 526' having an engagement length that is substantially equal to or equal to the cover length. When communications node 500' is attached to an outer surface of a tubular, only engagement surface 530' of the single integral engagement portion 526' is in contact with the outer surface of the tubular. The entire engagement surface 530' or a portion of the engagement surface 530' may be in contact with an outer surface of the tubular.

Figure 6:
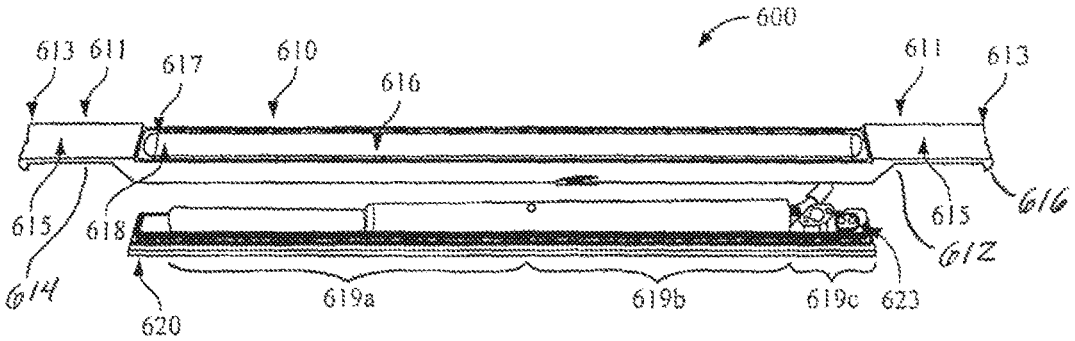
FIG. 6 presents a perspective view of an illustrative, nonexclusive example of a communications node before the body and the cover are sealed together, according to the present disclosure.

FIG. 6 is a perspective view of an illustrative, nonexclusive example of a communications node, i.e., communications node 600 before the body 610 and the cover 620 are sealed together using, for example a chemical bonding material, including for example, an epoxy. Communications node 600 includes body 610 and cover 620. Body 610 includes an interior portion 616 configured to receive an electrical component, and has a body length, a body width, and a body depth. The body 610 also includes a first chamfered perimeter 617 defining an open top portion 618. The body 610 includes a pair of opposing lengthwise tabs 611 each extending from a linear end 612 of the body 610 adjacent to the open top portion 618, each of the lengthwise tabs 611 having a tab length, a tab thickness less than the depth of the body, a tab terminal end 613, and a first tab surface 614 and an opposing second tab surface 615. The opposing second tab surface 615 is a radiused tab surface along the tab length, where the curve can be selected to conform to a diameter of a particular tubular to which communications node 600 will be attached. The lengthwise tabs 611 may further comprise a tab terminal projection 616 extending from the first tab surface 614 at the terminal end 613.

Cover 620 has a cover length, a cover width, and a cover thickness, the cover 620 being configured to cover the open top portion 618 of body 610 and enclose the interior portion 616 of body 610. The cover 620 includes a first surface and an opposing second surface. The first surface can comprise a second chamfered perimeter 623 configured to sealingly engage with the first chamfered perimeter 617 of body 610.

The body 610 and the cover 620 including one or more electrical components, are sealed via the second chamfered perimeter 623 of the cover 620 configured to sealingly engage with the first chamfered perimeter 617 of body 610 and a sealing material for sealing the cover to the body via said first chamfered perimeter 617 and the second chamfered perimeter 623. The sealing material can be a chemical bonding material, including but not limited to, an epoxy.

Cover 620 illustrated in FIG. 6 includes electrical components including battery pack 619*a*, circuit board 619*b*, and 2 piezo assemblies 619*c*. The battery pack can include but is not limited to, two (2) 3-cell battery packs, for example, lithium battery packs. The batteries and the circuit board can be potted as one unit, and the piezos can have their own mechanical clamping and potting.

Figure 7A:
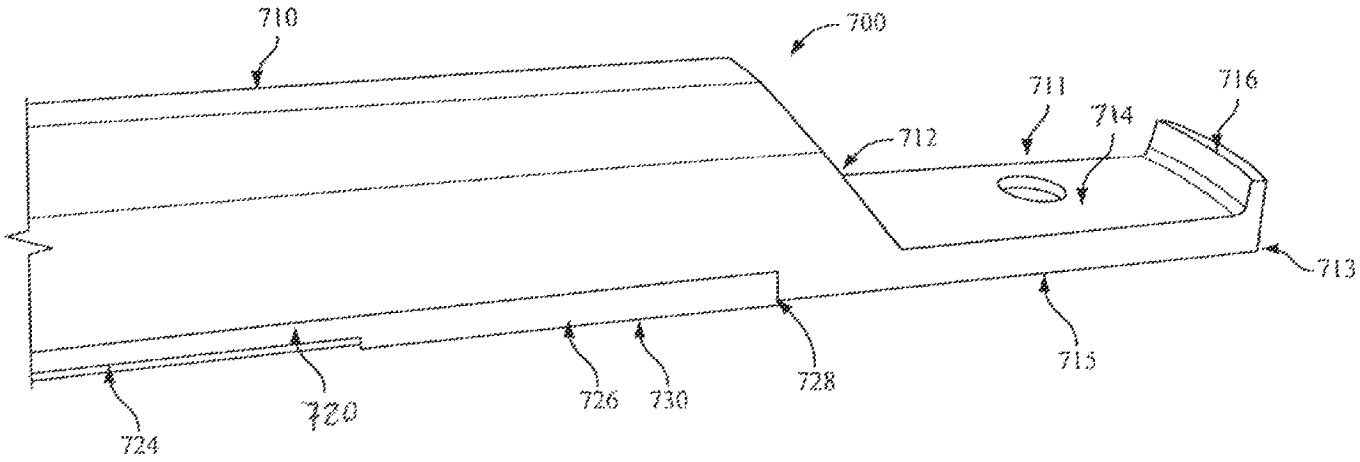
FIG. 7A presents a perspective partial view of a further illustrative, nonexclusive example of a communications node, according to the present disclosure.

FIG. 7A is a perspective partial view of an illustrative, nonexclusive example of a communications node. 700 including body 710 and cover 720. Body 710 includes lengthwise tab 711 extending from a linear end 712 of the body 710, the lengthwise tabs 711 having a tab length, a tab thickness less than the depth of the body, a tab terminal end 713, and a first tab surface 714 and an opposing second tab surface 715. The lengthwise tab further includes a tab terminal projection 716 extending from the first tab surface 714 at the terminal end 713. The body 710 and the cover 720 together defining shoulder 728.

Cover 720 has a cover length, a cover width, and a cover thickness, the cover 720 being configured to cover the open top portion of body 710 and enclose the interior portion of body 710. The cover 720 includes a first surface (not shown) and an opposing second surface 724. The first surface can comprise a second chamfered perimeter configured to sealingly engage with the first chamfered perimeter of body 710. The opposing second surface 724 of cover 720 can include at least one integral engagement portion 726 projecting from the opposing second surface and having an engagement surface 730 and an engagement length. When a sealed communications node including body 710 and cover 720 is attached to an outer surface of a tubular, only engagement surface 730 of the at least one integral engagement portion 720 is in contact with the outer surface of the tubular. The entire engagement surface 730 or a portion of the engagement surface 730 may be in contact with an outer surface of the tubular. The engagement surface 730 is a radiused engagement surface along the engagement length, where the curve can be selected to conform to a diameter of a particular tubular to which a sealed communications node including body 710, cover 720, and electrical components, will be attached. Alternatively, engagement surface 730 may be a V-configuration engagement surface formed by an obtuse angle, the V-configuration engagement surface provided along the engagement length.

Figure 7B:
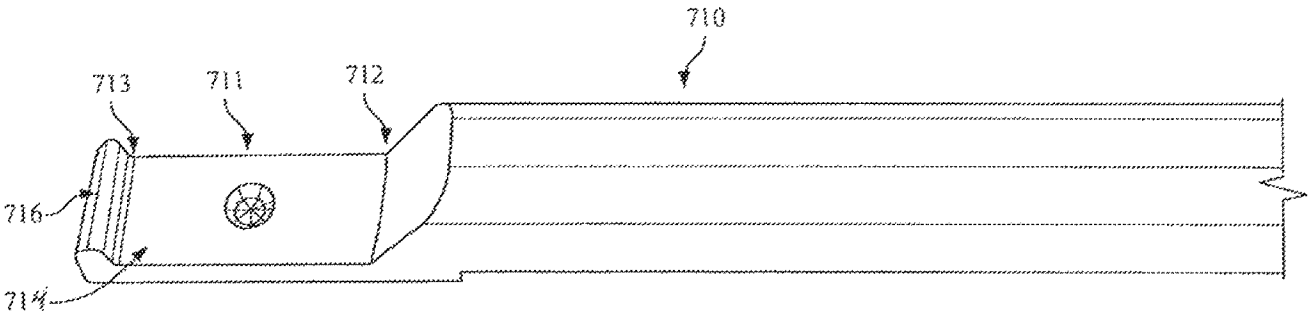
FIG. 7B presents a perspective partial view of an illustrative, nonexclusive example of a housing body, according to the present disclosure.

FIG. 7B is a perspective partial view of an illustrative, nonexclusive example of a body 710 of a housing. Body 710 includes lengthwise tab 711 extending from a linear end 712 of the body 710, the lengthwise tabs 711 having a tab length, a tab thickness less than the depth of the body, a tab terminal end 713, and a first tab surface 714 and an opposing second tab surface (not shown). The lengthwise tab further includes a tab terminal projection 716 extending from the first tab surface 714 at the terminal end 713.

Figure 7C:
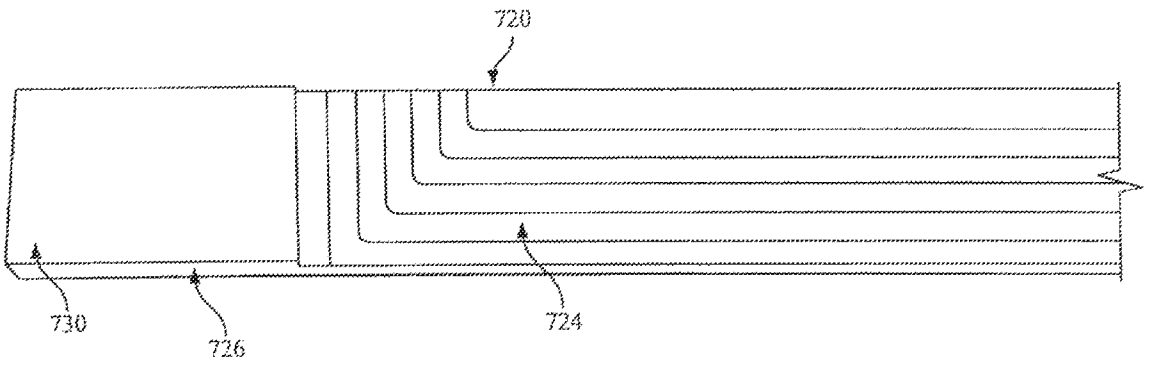
FIG. 7C presents a partial bottom view of an illustrative, nonexclusive example of a housing cover, according to the present disclosure.

FIG. 7C is a partial bottom view of an illustrative, nonexclusive example of a cover 720 of a housing. Cover 720 has a cover length, a cover width, and a cover thickness, the cover 720 being configured to cover the open top portion of body 710 and enclose the interior portion of body 710. The cover 720 includes a first surface (not shown) and an opposing second surface 724. The first surface can comprise a second chamfered perimeter configured to sealingly engage with the first chamfered perimeter of body 710. The opposing second surface 724 of cover 720 can include at least one integral engagement portion 726 projecting from the opposing second surface and having an engagement surface 730 and an engagement length. When a sealed communications node including body 710 and cover 720 is attached to an outer surface of a tubular, only engagement surface 730 of the at least one integral engagement portion 720 is in contact with the outer surface of the tubular. The entire engagement surface 730 or a portion of the engagement surface 730 may be in contact with an outer surface of the tubular. The engagement surface 730 is a radiused engagement surface along the engagement length, where the curve can be selected to conform to a diameter of a particular tubular to which a sealed communications node including body 710, cover 720, and electrical components, will be attached. Alternatively, engagement surface 730 may be a V-configuration engagement surface formed by an obtuse angle, the V-configuration engagement surface provided along the engagement length.

The body 710 and the cover 720 including one or more electrical components, are sealed via the second chamfered perimeter of the cover 720 configured to sealingly engage with the first chamfered perimeter of body 710 and a sealing material for sealing the cover to the body via said first chamfered perimeter and the second chamfered perimeter. The sealing material can be a chemical bonding material, including but not limited to, an epoxy.

Figure 7D:
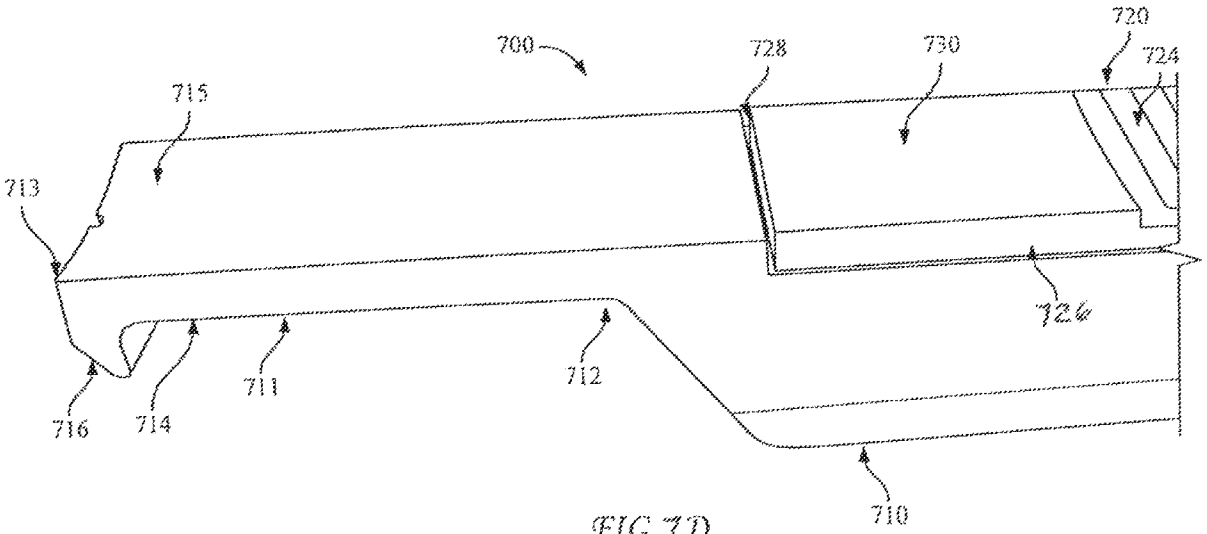
FIG. 7D presents a perspective partial bottom view of an illustrative, nonexclusive example of a communications node including a body and a cover, according to the present disclosure.

FIG. 7D is a perspective partial bottom view of an illustrative, nonexclusive example of communications node 700 including body 710 and cover 720. Body 710 includes lengthwise tab 711 extending from a linear end 712 of the body 710, the lengthwise tabs 711 having a tab length, a tab thickness less than the depth of the body, a tab terminal end 713, and a first tab surface 714 and an opposing second tab surface 715. The lengthwise tab further includes a tab terminal projection 716 extending from the first tab surface 714 at the terminal end 713. The body 710 and the cover 720 together defining shoulder 728.

Cover 720 has a cover length, a cover width, and a cover thickness, the cover 720 being configured to cover the open top portion of body 710 and enclose the interior portion of body 710. The cover 720 includes a first surface (not shown) and an opposing second surface 724. The first surface can comprise a second chamfered perimeter configured to sealingly engage with the first chamfered perimeter of body 710. The opposing second surface 724 of cover 720 can include at least one integral engagement portion 726 projecting from the opposing second surface and having an engagement surface 730 and an engagement length. When sealed communications node 700 is attached to an outer surface of a tubular, only engagement surface 730 of the at least one integral engagement portion 726 is in contact with the outer surface of the tubular. That is, the opposing second tab surface 715 is not in contact with the outer surface of the tubular. The entire engagement surface 730 or a portion of the engagement surface 730 may be in contact with an outer surface of the tubular. Both the engagement surface 730 and the opposing second tab surface 715 are radiused engagement surfaces provided along the engagement length, and the tab length, respectively, where the curve can be selected to conform to a diameter of a particular tubular to which a sealed communications node including body 710, cover 720, and electrical components, will be attached. Alternatively, engagement surface 730 and/or opposing second tab surface 715 may be a V-configuration engagement surface and/or V-configuration opposing second tab surface formed by an obtuse angle, the V-configuration surface provided along the engagement length and/or the tab length.

Figure 8A:
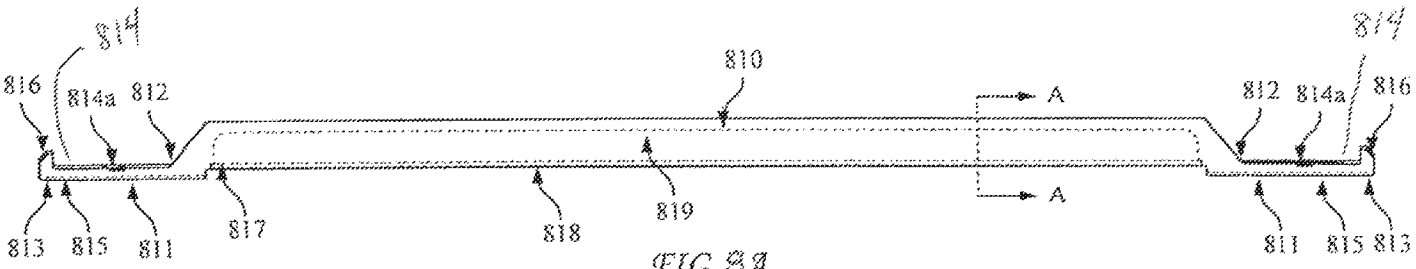
FIGS. 8A-D present a side view of a housing body (FIG. 8A), a bottom view of the housing body (FIG. 8B), a top-down view of the housing cover (FIG. 8C), and a side view of the housing cover (FIG. 8D), according to the present disclosure.

FIG. 8A is a side view of body 810 including an interior portion 819 configured to receive an electrical component, and has a body length, a body width, and a body depth. The body MO also includes a first chamfered perimeter 817 defining an open top portion 818. The body 810 includes a pair of opposing lengthwise tabs 811 each extending from a linear end 812 of the body 810 adjacent to the open top portion 818, each of the lengthwise tabs 811 having a tab length, a tab thickness less than the depth of the body, a tab terminal end 813, and a first tab surface 814 and an opposing second tab surface 815. The lengthwise tabs may further comprise a tab terminal projection 816 extending from the first tab surface 814 at the terminal end 813 and a recessed portion 814*a*.

Figure 8B:
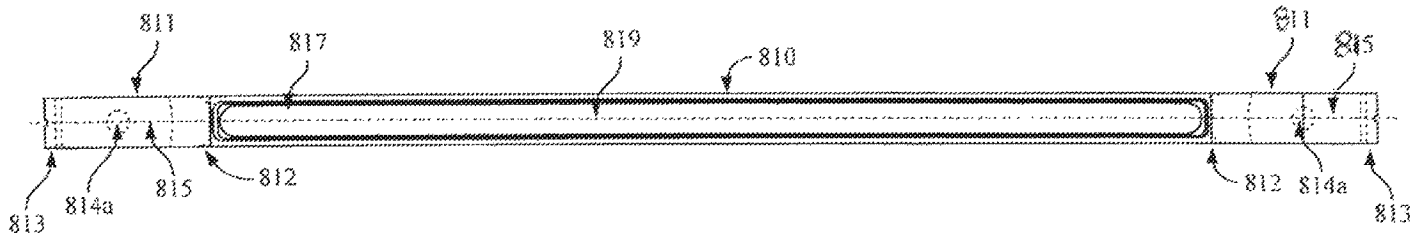

FIG. 8B is a bottom view of body 810 including an interior portion 819 configured to receive an electrical component, and has a body length, a body width, and a body depth. The body 810 also includes a first chamfered perimeter 817 defining an open top portion. The body 810 includes a pair of opposing lengthwise tabs 811 each extending from a linear end 812 of the body 810 adjacent to the open top portion, each of the lengthwise tabs 811 having a tab length, a tab thickness less than the depth of the body, a tab terminal end 813, and a first tab surface and an opposing second tab surface 815. The lengthwise tabs may further comprise a tab terminal projection extending from the first tab surface at the terminal end 813 and a recessed portion 814*a*.

In FIGS. 8A and 8B, the opposing second tab surface 815 comprises a V-configuration tab surface formed by an obtuse angle, the V-configuration tab surface provided along the tab length. The obtuse angle can be selected in accordance with an obtuse angle of a V-configuration engagement surface of an integral engagement portion of a cover 820 in order to accommodate a particular range of tubular diameters. Suitable obtuse angles are described herein.

Figure 8C:
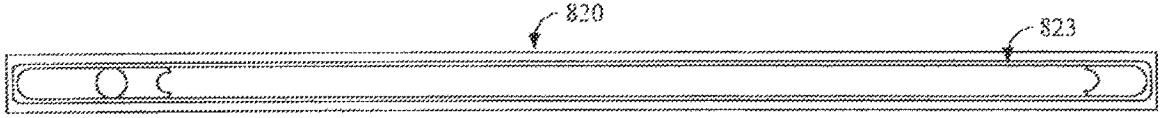

FIG. 8C is a top down view of cover 820 that has a cover length, a cover width, and a cover thickness, the cover being configured to cover the open top portion 818 of body 810 and enclose the interior portion 819 of body 810. The cover 820 includes a first surface comprising a second chamfered perimeter 823 configured to sealingly engage with the first chamfered perimeter 817 of body 810. Cover 820 includes a single continuous integral engagement portion 826 (FIG. 8D) having an engagement length that is equal to or substantially equal to the cover length, an engagement thickness, and an engagement surface opposite the first surface of the cover, the engagement surface being a V-configuration engagement surface formed by an obtuse angle, the V-configuration engagement surface provided along the engagement length and the obtuse angle is selected to accommodate a particular range of tubular diameters. Suitable obtuse angles are described herein.

Figure 8D:
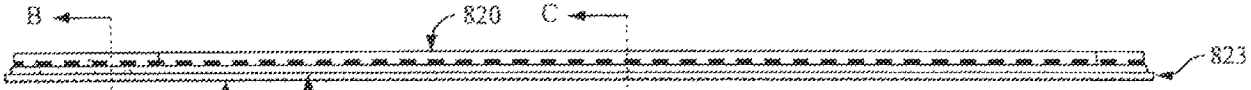

FIG. 8D is a side view of cover 820 including second chamfered perimeter 823, a single continuous integral engagement portion 826 having an engagement length that is equal to or substantially equal to the cover length, an engagement thickness, and an engagement surface opposite the first surface of the cover, the engagement surface being a V-configuration engagement surface formed by an obtuse angle. The V-configuration engagement surface provided along the engagement length. The obtuse angle is selected to accommodate a particular range of tubular diameters. Suitable obtuse angles are described herein. A portion of the engagement surface 830 may be in direct contact with an outer surface of the tubular.

Figure 8E:
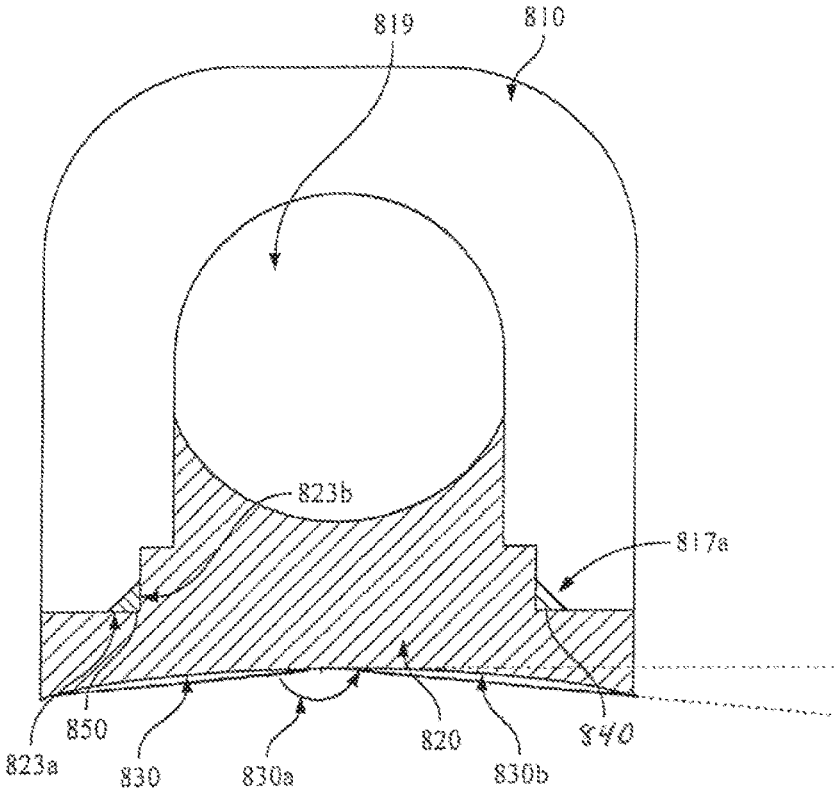
FIG. 8E presents a cross-section view of an illustrative, nonexclusive example of a housing including a body and a cover sealed with a sealing material, according to the present disclosure.

FIG. 8E is a cross-section view of housing 800 including body 810 and cover 820 sealed with a sealing material 840. The body includes interior portion 819 and chamfered perimeter 817 (FIG. 8A) including angled edge 817*a*. The cover 820 includes a V-configuration engagement surface 830 formed by an obtuse angle 830*a* (see also angle 830*b* which can be from about 1° to about 15°, from about 2° to about 12°, from about 3° to about 10°, from about 4° to about 8°, from about 5° to about 7°, about 5°, about 6°, or about 7°) the V-configuration surface provided along the engagement length. The cover includes chamfered perimeter 823 (FIG. 8D) that may include cover edges, for example, cover edges 823*a* and 823*b*, sufficient to create a space upon engagement with a first perimeter 817 of a body portion 810. Chamfered perimeters 817 and 823 are configured such that upon engagement, a space 850 is created and defined by chamfered edges of the chamfered perimeters 817 and 823, where upon sealing with a sealing material 840, the sealing material fills the space 850 resulting in an improved seal. For exemplary purposes only, upon engaging cover 820 with body 810 via the first and second chamfered perimeters, a space is created between angled body edge 817*a* of body 810 and cover edges 823*a* and 823*b* of cover 820 such that the space 850 created is defined by edges 817*a*, 823*a*, and 823*b*, where upon sealing with a sealing material, the sealing material fills the space 850 resulting in an improved seal.

Figure 8F:
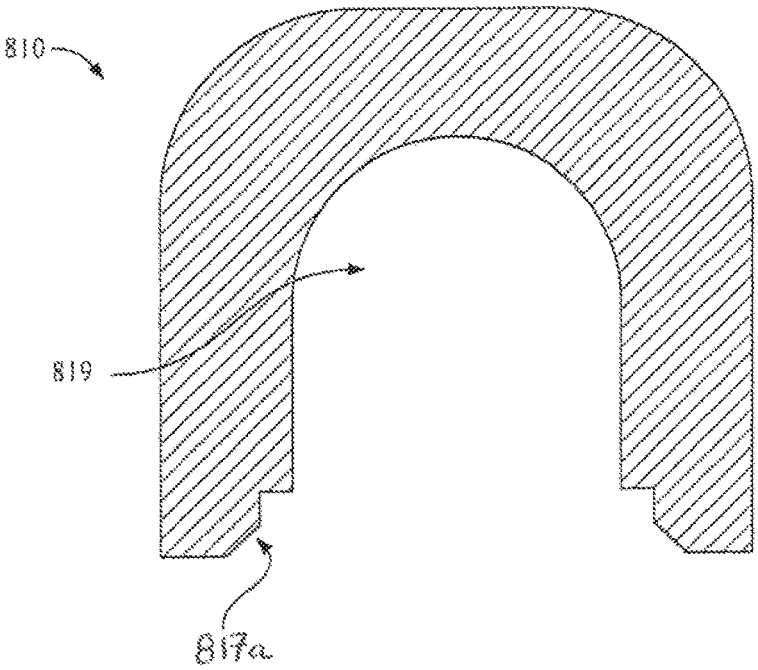
FIG. 8F presents a cross-section view of an illustrative, nonexclusive example of a housing body taken along section a-a of FIG. 8A, according to the present disclosure.

FIG. 8F is a cross-section view of cover 820 along section a-a of FIG. 8A, including body 810, interior portion 819, and first chamfered perimeter 817 including angled edge 817*a* whereby upon engaging cover 820 with body 810 via the first and second chamfered perimeters, a space 850 is created between angled body edge 817*a* of body 810 and cover edges 823*a* and 823*b* of cover 820 (see e.g., FIG. 8E) such that the space 850 created is defined by edges 817*a*, 823*a*, and 823*b*, where upon sealing with a sealing material, the sealing material fills the space 850 resulting in an improved seal.

Figure 8G:
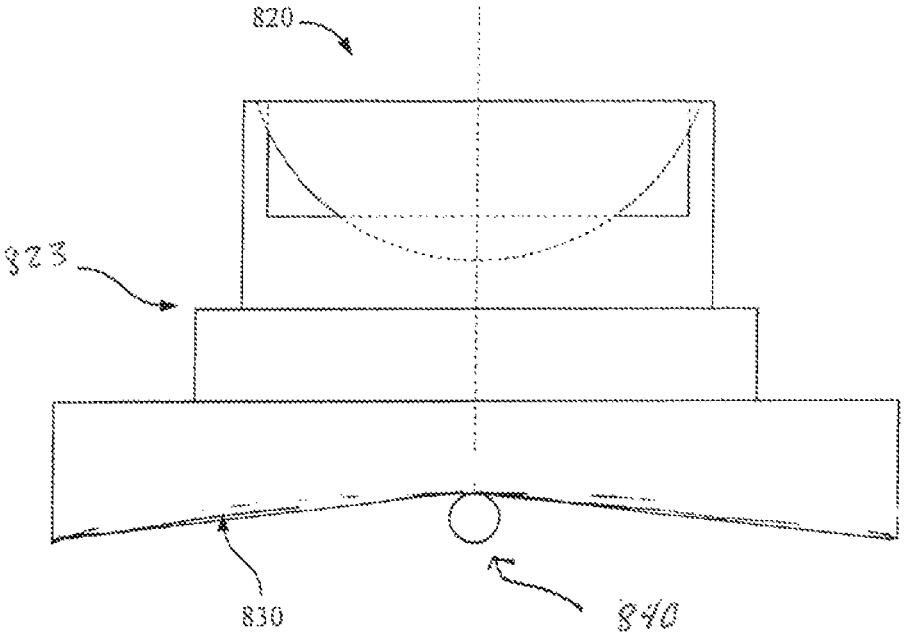
FIG. 8G presents a cross-section view of an illustrative, nonexclusive example of a housing cover taken along section b-b of FIG. 8D, according to the present disclosure.

FIG. 8G is a cross-section view of cover 820 taken along section b-b of FIG. 8D, including cover 820, second chamfered perimeter 823, and V-configuration engagement surface 830, and malleable wire 840.

Methods

Figure 9:
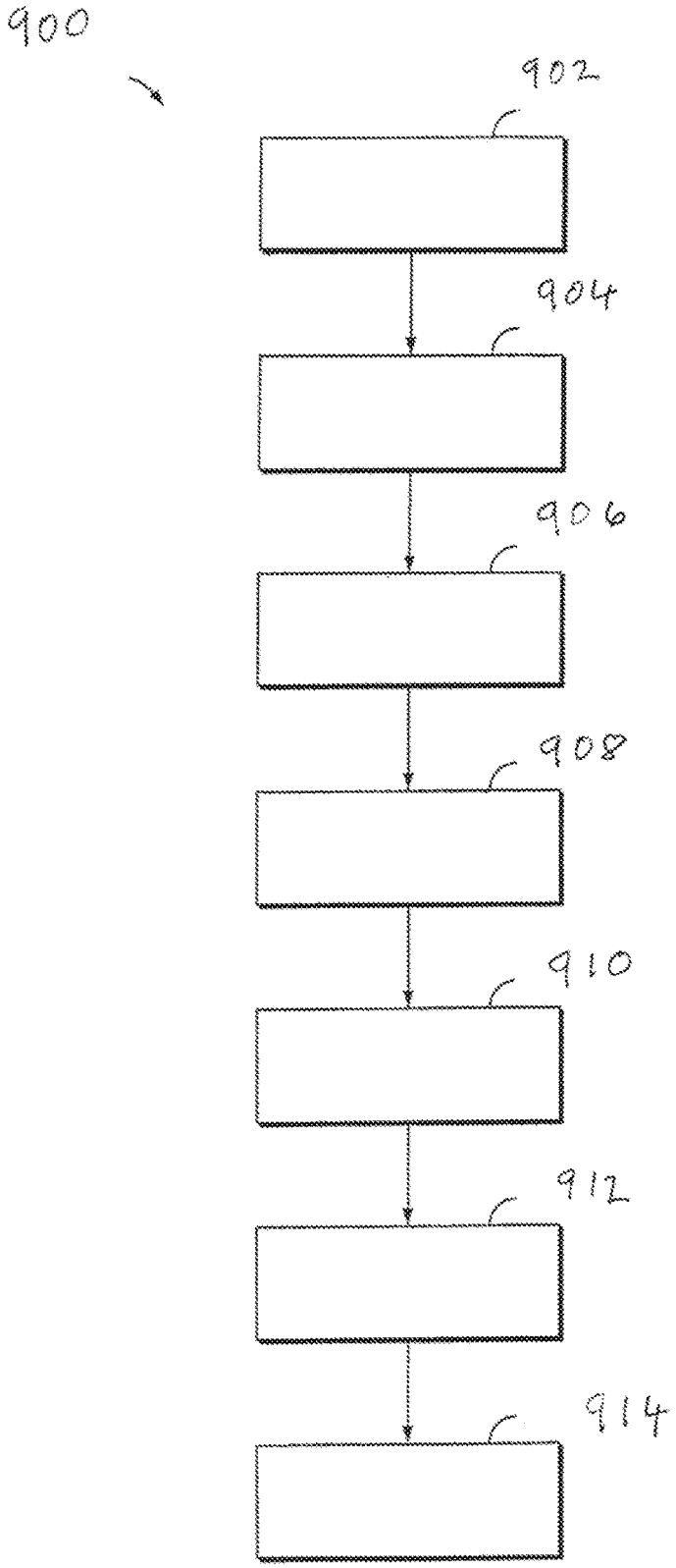
FIG. 9 is a flowchart demonstrating an illustrative, nonexclusive example of steps of a method for reservoir formation characterization in accordance with the presently described subject matter.

FIG. 9 provides a flow chart for a method 900 of reservoir formation characterization within a wellbore. The method 900 includes the steps of 902 sensing one or more reservoir formation parameters indicative of at least one reservoir formation property via one or more sensors positioned along a tubular body; 904 receiving signals from the one or more sensors with at least one sensor communications node; 906 transmitting those signals via a transceiver or transmitter to an intermediate communications node attached to a wall of the tubular body; 908 relaying signals received by the intermediate communications node to at least one additional intermediate communications node via a transceiver or transmitter; 910 relaying signals received by the additional intermediate communications node to a topside communications node via a transceiver or transmitter; 912 determining at least one reservoir formation property from the signals received from the topside communications node; and 914 updating a reservoir formation model in response to the determined at least one reservoir formation property. When the well is a production well, the method can optionally include optimizing production performance based on the updated reservoir formation model.

The tubular body may be a string of production tubing. Alternatively, the tubular body may be a string of casing. In this instance, the wellbore may have more than one casing string, including a string of surface casing, one or more intermediate casing strings, and a production casing. In any aspect, the wellbore is completed for the purpose of conducting hydrocarbon recovery operations.

The method 900 also provides for attaching a series of communications nodes to the joints of pipe. This is provided at Box 902. The communications nodes are attached according to a pre-designated spacing.

The communications nodes will include a topside communications node that is placed along the wellbore proximate the surface. This is the uppermost communications node along the wellbore. The topside communications node may be a virtual topside communications node placed below grade as presently described herein, for example, on an uppermost joint of casing or tubing, either below ground or in a cellar. Alternatively, the topside communications node may be placed above grade by connecting that node to the well head.

The communications nodes will also include a plurality of subsurface communications nodes. In one aspect, each joint of pipe receives a subsurface communications node. Each of the subsurface communications nodes may be attached to a tubular by welding, by adhesives, or using one or more clamps.

The subsurface communications nodes can be configured to transmit acoustic waves up to the topside node. Each subsurface communications node includes a transceiver that receives an acoustic signal from a previous communications node, and then transmits or relays that acoustic signal to a next communications node, in node-to-node arrangement. The topside communications node then transmits signals from an uppermost subsurface communications node to a receiver at the surface.

The method 900 also includes providing one or more sensors along a tubular body. This is shown at Box 902. The sensors operate to measure parameters indicative of reservoir formation parameters, in accordance with the presently described subject matter. The sensors may include but are not limited to the sensors described herein including any one or more of, for example, flow measurement devices, flow distribution measurement devices, fluid velocity sensors, pressure sensors, multiphase flow sensors, fluid density sensors, ultrasound sensors, Doppler shift sensors, microphones, chemical sensors, imaging devices, fluid identification sensors, impedance, attenuation, and temperature sensors. Selected subsurface sensor communications nodes will either house or will be in communication, e.g., electrical communication, with a respective sensor. For example, three or more subsurface sensor communications nodes 904 will receive signals from a flow measurement device. These selected subsurface sensor communications nodes can be placed along a subsurface formation where production is taking place, for example, in each production zone. These selected nodes are referred to as sensor communications nodes.

Selected subsurface sensor communications nodes may house (or be in electrical communication with) a fluid probe and/or a material probe in accordance with the presently described subject matter. Such probes can include, but are not limited to, for example, a fluid identification sensor, a flow meter. Selected subsurface sensor communications nodes may house (or be in electrical communication with) a temperature sensor. Each of these communications nodes are again referred to as sensor communications nodes.

The sensor communications nodes receive electrical signals from the sensors 904, and then generate an acoustic signal using an electro-acoustic transducer. The acoustic signal corresponds to readings sensed by the respective sensors. The transceivers in the subsurface communications nodes then transmit the acoustic signals up the wellbore 906, node-to-node 908.

The method 900 may also include providing a receiver. The receiver is placed at the surface. The receiver has a processor that processes signals received from the topside communications node, such as through the use of firmware and/or software. The receiver preferably receives signals, e.g., electrical or optical signals, via a so-called "Class I, Division 1" conduit or through a radio signal. The processor processes signals to identify which signals correlate to which sensor communications node that originated the signal. In this way, the operator will understand the depth or zone at which the readings are being made.

The method includes transmitting signals from each of the communications nodes up the wellbore to a topside communications node 910, and optionally to a receiver. The signals are acoustic signals that have a resonance amplitude. These signals are sent up the wellbore, node-to-node. In one aspect, piezo wafers or other piezoelectric elements are used to receive and transmit acoustic signals. In another aspect, multiple stacks of piezoelectric crystals or other magnetostrictive devices are used. Signals are created by applying electrical signals of an appropriate frequency across one or more piezoelectric crystals, causing them to vibrate at a rate corresponding to the frequency of the desired acoustic signal.

In one aspect, the data transmitted between the nodes is represented by acoustic waves according to a multiple frequency shift keying (MFSK) modulation method. Although MFSK is well-suited for this application, its use as an example is not intended to be limiting. It is known that various alternative forms of digital data modulation are available, for example, frequency shift keying (FSK), multi-frequency signaling (MF), phase shift keying (PSK), pulse position modulation (PPM), and on-off keying (OOK). In one embodiment, every 4 bits of data are represented by selecting one out of sixteen possible tones for broadcast.

Acoustic telemetry along tubulars is characterized by multi-path or reverberation which persists for a period of milliseconds. As a result, a transmitted tone of a few milliseconds duration determines the dominant received frequency for a time period of additional milliseconds. The communication nodes may determine the transmitted frequency by receiving or "listening to" the acoustic waves for a time period corresponding to the reverberation time, which is typically much longer than the transmission time. The tone duration can be long enough that the frequency spectrum of the tone burst has negligible energy at the frequencies of neighboring tones, and the listening time must be long enough for the multipath to become substantially reduced in amplitude. In one embodiment, the tone duration is 2 ms, then the transmitter remains silent for 48 milliseconds before sending the next tone. The receiver, however, listens for 2+48=50 ms to determine each transmitted frequency, utilizing the long reverberation time to make the frequency determination more certain. The energy required to transmit data is reduced by transmitting for a short period of time and exploiting the multi-path to extend the listening time during which the transmitted frequency may be detected.

In one embodiment, an MFSK modulation is employed where each tone is selected from an alphabet of 16 tones, so that it represents 4 bits of information. With a listening time of 50 ms, for example, the data rate is 80 bits per second.

The tones are selected to be within a frequency band where the signal is detectable above ambient and electronic noise at least two nodes away from the transmitter node. In this way, if one node fails, it can be bypassed by transmitting data directly between its nearest neighbors above or below. The tones may be evenly spaced in period within a frequency band from about 50 kHz to about 500 kHz, from about 50 kHz to about 300 kHz, from about 60 kHz to about 200 kHz, from about 65 kHz to about 175 kHz, from about 70 kHz to about 160 kHz, from about 75 kHz to about 150 kHz, from about 80 kHz to about 140 kHz, from about 85 kHz to about 135 kHz, from about 90 kHz to about 130 kHz, or from about 100 kHz to about 125 kHz. The tones may be evenly spaced in frequency within a frequency band from about 100 kHz to 125 kHz.

The nodes can employ a "frequency hopping" method where the last transmitted tone is not immediately re-used. This prevents extended reverberation from being mistaken for a second transmitted tone at the same frequency. For example, 17 tones are utilized for representing data in an MFSK modulation scheme; however, the last-used tone is excluded so that only 16 tones are actually available for selection at any time.

The communications nodes will transmit data as mechanical waves at a rate exceeding about 50 bps.

The method 900 may also include analyzing the signals received from the communications nodes. The signals are analyzed to determine 912 and update 914 at least one reservoir formation property. Where the sensors are fluid measurement devices, the presence or even the volume of fluid flow can be measured. Where the sensors are fluid identification sensors, the nature of the fluid, e.g., oil vs. water vs. gas, can be learned. Where the sensors are temperature sensors, temperature data can be gathered. Where the sensors are piezoelectric transducers or microphones, sound or seismic or vibrational or wave data may be gathered. Where the sensors are pressure sensors, pressure data can be gathered. Pressure drop may be measured across an inflow control device downhole. For example, an orifice plate may be placed in a tubing with pressure sensors measuring the pressure differential on either side of the plate.

Changes in temperature and pressure and sound may be indicative of changes in fluid flow or phase. The communications nodes generate signals that correspond to any or all of these wellbore fluid parameters.

In one aspect, analyzing the signals means reviewing historical data as a function of wellbore depth. For example, a chart or graph showing changes in temperature or changes in pressure at a specific zone as a function of time may be provided. In another aspect, analyzing the signals means comparing sensor readings along various zones of interest. In this way, a temperature profile or a fluid identification profile or a flow volume profile along the wellbore may be created. In yet another aspect, analyzing the signals means acquiring numerical data and entering it into reservoir simulation software. The reservoir simulator may then be used to predict future pressure changes, earth subsidence (which influences hardware integrity), fluid flow trends, or other factors.

The method 900 may include the identification of a subsurface communications node that is sending signals indicative of a need for remedial action along the wellbore. Such signals may be signals indicative of poor well performance, including for example, poor fluid flow, of a loss of pressure, or of gas or water breakthrough. Accordingly, the method 900 may further include the step of optimizing production performance, including for example, but not limited to, actuating an inflow control device to adjust fluid flow along the wellbore. The step of actuating an inflow control device may comprise sending an acoustic signal down the subsurface communications nodes and to the sensor communications nodes, where an electrical signal is then sent to the inflow control device. The inflow control device has a controller, powered, for example, by batteries, that will open or close a sleeve as desired to improve or optimize well performance.

In the method 900, each of the communications nodes has an independent power source. The independent power source may be, for example, batteries, e.g., lithium batteries, or a fuel cell. Having a power source that resides within the housing of the communications nodes reduces the need for passing electrical connections through the housing, which could compromise fluid isolation. In addition, each of the intermediate communications nodes has a transducer and associated transceiver.

A signal may be sent from the surface to the communications nodes to switch them into a low-power, or "sleep," mode. This preserves battery life when real-time downhole data is not needed. The communications nodes may be turned back on to generate a flow profile along selected zones of the wellbore. In one aspect, the communications nodes are turned on prior to beginning an acid stimulation treatment. The sensors downhole will measure the flow rate of the stimulation fluid moving past each sensor communications node and out into the formation. In this way, real time information on the outflow profile is gathered. In a similar way, outflow data may be gathered where the wellbore is used as an injection well for water flooding or other secondary recovery operations.

A separate method for monitoring reservoir formation parameters in a wellbore is also provided herein. The method may include the use of upon an acoustic telemetry system for transmitting signals indicative of reservoir formation properties.

The method first includes receiving signals from a wellbore. Each signal defines a packet of information having (i) an identifier for a subsurface communications node originally transmitting the signal, and (ii) an acoustic waveform for the subsurface communications node originally transmitting the signal. The acoustic waveform is indicative of a wellbore fluid flow parameter or condition accordingly to the presently described subject matter. The fluid flow condition may include, but is not limited to, any one or more of (i) fluid flow volume, (ii) fluid identification, (iii) pressure, (iv) temperature, (v) impedance, (vi) fluid velocity, (vii) fluid density, (viii) fluid flow type, (ix) fluid composition, or (x) combinations thereof.

The method may also include correlating communications nodes to their respective locations in the wellbore. In addition, the method comprises processing the amplitude values to evaluate fluid flow conditions in the wellbore.

In this method, the subsurface communications nodes may be constructed in accordance with communications node according to the presently described subject matter, or other arrangement for acoustic transmission of data. Each of the subsurface communications nodes can be attached to an outer wall of the tubing or the casing string according to a pre-designated spacing. The subsurface communications nodes are configured to communicate by acoustic signals transmitted through the wall of a tubular body.

Reservoir formation parameters can be detected by sensors residing along a subsurface formation. The reservoir formation parameters can be detected by sensors residing along a tubular, including for example, production tubing. The sensors may include, but are not limited to, any one or more of: (i) fluid velocity measurement devices residing inside of the production tubing; (ii) temperature sensors that measure temperature of fluids flowing inside of the production tubing; (iii) pressure sensors that measure pressure inside of the production tubing, or pressure drop; (iv) fluid density sensors that measure the density of fluids inside of the production tubing; (v) microphones that provide passive acoustic monitoring to listen for the sound of gas entry into the production tubing or the opening and closing of the gas lift valve; (vi) ultrasound sensors that correlate changes in gas transmission with gas flows, bubbles, solids and other properties of flow along gas inlets; (vii) Doppler shift sensors; (viii) chemical sensors; (ix) an imaging device; and (x) combinations thereof to produce direct or "virtual" sensors of flows of gas, liquids and solids.

Electrical, electro-magnetic or fiber optic signals are sent from the sensors to selected subsurface communications nodes. Electro-acoustic transducers within the sensor communications nodes, in turn, send acoustic signals to a transceiver, which then transmits the signals acoustically. The transceivers in the selected subsurface communications nodes transmit acoustic signals up the wellbore representative of formation parameters, including fluid flow readings, node-to-node. Signals are transmitted from the sensor communications nodes to a receiver at a surface through a series of subsurface communications nodes, with each of the subsurface communications nodes being attached to a wall, e.g., an outer wall, of a tubular, e.g., production tubing or casing according to a pre-designated spacing, where, for example, each production zone can include at least one sensor and at least one sensor communications node, where the sensor may or may not reside within the housing of its associated sensor communications node.

The methods described above may be practiced either before or after a wellbore has been completed. For example, after a portion of a wellbore has been drilled, a casing crew may be brought in to run casing into the wellbore. The casing crew will be trained in how to install subsurface communications nodes onto an outer wall of the production tubing and/or joints of casing. The communications nodes are clamped onto the pipe joints during run-in to form a wireless acoustic telemetry system. After all of the casing strings are in place and the production tubing is in place, the communications nodes are activated. Signals are delivered from fluid flow sensors, provided in each production zone of a multi-zone production zone, to sensor communications nodes. Those nodes transmit the signals as acoustic signals via a plurality of intermediate communications nodes and a topside communications node, node-to-node, up to a receiver at the surface. The acoustic signals are packets of information that identify the sensor communications node sending the original waveform, and the fluid flow data.

Each communications node may contain a piezoelectric device to allow acoustic communication to nearby nodes. Each node is independently powered by, for example, an internal battery or fuel cell. The nodes may include memory chips to store data.

The presently described systems and methods can be used to assess zonal fluid flow, and assess production conditions in a multi-zone, multiphase fluid producing well. The information generated can be used to generate maps and/or diagnose production problems, including for example, identifying dead production zones, cross-flow, contamination, plugging, reduced production, lost circulation, paraffin buildup/breakout, water-cut, corrosion, and the like.

The presently described subject matter, in another aspect, provides optimization of production performance to improve production efficiency, output, quality, composition, and the like, in one or more production zones of a well. Optimization can include any of chemical optimization, including, but not limited to, for example the use of scavengers, inhibitors, anti-corrosives, chemically consolidating to strengthen a formation, and the like as described herein; mechanical treatment including for example, the use of artificial lift systems, flow restriction (using a back pressure regulator), injection, e.g., oil or water, and/or gravel packs and screen, e.g., to reduce sand, etc.; heat treatment, for example, chemical, mechanical and heat can be used to treat paraffin issues; and sealing to remedy lost circulation issues. Other optimization methods can include adjusting pump speed and/or casing pressure; zonal flow control; and for off-shore applications, employing the use of electrical submersible pumping systems.

As can be seen, a novel downhole telemetry system is provided, as well as a novel method for the wireless transmission of information using a plurality of data transmission nodes for reservoir formation characterization, by, for example, detecting and/or monitoring reservoir formation parameters indicative of one or more reservoir formation properties including for example, but not limited to, porosity, permeability, and hydrocarbon accumulation. The presently described subject matter improves well performance by using sensors, including for example, permanent sensors, attachable sensors, and the like, to measure data along the wellbore, along with, for example, downhole devices to reconfigure a completion and/or other devices to improve and/or optimize well performance.

With permanent nodes affixed on external surfaces of a tubular body, the acoustic velocity of rock formations can be measured according to the processes described herein. For example, with one of the nodes as a source and one or more of other nodes as receivers, the flight or travel time of the acoustic pulse between the source node and receiver nodes can be measured and the acoustic velocity or sound speed of the rock formation can be determined. Since the acoustic pulses of high frequencies can be used, the resolution or determination of the acoustic velocity estimation can be significantly improved over conventional low-frequency sonic logging or surveying. Another method to measure the acoustic velocity or sound speed of the rock formation according to the methods described herein is to use a pulse-echo method with a single node as both source and receiver. The acoustic velocity determined for the rock matrix can then be used to estimate the porosity and/or permeability of the reservoir rock using established empirical relationships such as the Wyllie time-average equation that is based on acoustic velocity. Similar to the acoustic velocity or sound speed, the acoustic attenuation of the rock formation could also be obtained and that estimation also may be used to correlate with the porosity and permeability estimates.

In various other embodiments, the methods and systems disclosed herein may also include the step of sensing one or more reservoir formation parameters using a fiber-based sensor system as one of the at least one sensor communication nodes to receive acoustic signals. The fiber-based sensor may comprise at least one of a fiber optic sensor, an acoustic sensor system such as a piezo-electric system, and a radio frequency (RF) system to sense and/or transmit acoustic signals. In some embodiments, the fiber optic sensor system may comprises fiber Bragg grating (FBG) such as is known in the fiber-optic system. In some aspects, the methods may include sending an acoustic signal from at least one acoustic telemetry node at a frequency in or below the ultrasound frequency band and recording the acoustic signal sent using the fiber-based sensor system. For example, a distributed acoustic sensing (DAS) fiber optic system may be utilized to record passive sound reflections (low frequency or ultrasound) or active echoes or sounds generated from low or high frequency waves generated from a node or piezo transducer that is used to transmit signals that may be useful for characterizing the formation, fractures, well completions, production information, etc.

Gratings or other mechanisms on the fiber may be utilized to assist with the sensing function, such as being the "microphone" while the nodes themselves may function to generate or reproduce acoustic signals. Some systems may comprise a hybrid of both fiber-based and acoustic vibrational signals by which to communicate between nodes and/or transmitters. Such measured and transmitted information may be indicative of reservoir lithology, fracture creation and location, proppant location, gravel packing information, cementing information, and/or acid stimulation response or information.

At least one of the transmitter, the transceiver, the intermediate communications node and the at least one additional intermediate communications node may further comprise the fiber-based sensor system to transmit sensed signals. The fiber-based system may be part of a hybrid system wherein the fiber-based system portion further comprises using at least one of a fiber optic system, a radio frequency system, and an acoustic system to transmit and/or received signals, such as to or from a communications node. The methods disclosed herein may further comprise receiving acoustic signals on both the fiber-based sensor system and on a piezo-electric acoustic transducer receiver and transmit both received signals using at least one of a fiber optic system, a radio frequency system, and an acoustic system to transmit signals to a communications node.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A downhole wireless telemetry system, comprising:

at least one sensor disposed along a tubular body;

at least one sensor communications node placed along the tubular body and affixed to a wall of the tubular body, the sensor communications node being in electrical communication with the at least one sensor and configured to receive signals therefrom;

a topside communications node placed proximate a surface;

a plurality of electro-acoustic communications nodes spaced along the tubular body and attached to a wall of the tubular body, each electro-acoustic communications node comprising a housing having a mounting face for mounting to a surface of the tubular body;

a piezoelectric receiver positioned within the housing, the piezoelectric receiver structured and arranged to receive acoustic waves that propagate through the tubular body;

a piezoelectric transmitter positioned within the housing, the piezoelectric transmitter structured and arranged to transmit acoustic waves through the tubular body; and a power source comprising one or more batteries positioned within the housing;

wherein the electro-acoustic communications nodes are configured to transmit signals received from the at least one sensor communications node to the topside communications node in a substantially node-to-node arrangement; and wherein at least one of the piezoelectric transmitter and the piezoelectric receiver comprises multiple piezoelectric disks, each piezoelectric disk having at least a pair of electrodes connected in series with an adjacent piezoelectric disk.

2. The system of claim 1, wherein at least one of the sensor communication nodes uses a fiber-based sensor system to sense one or more reservoir formation parameters.

3. The system of claim 2, wherein at least one of the transmitter, the transceiver, and at least one of the plurality of electro-acoustic communications nodes further comprises the fiber-based sensor system to transmit sensed signals.

4. The system of claim 2, wherein the fiber-based sensor system comprises a fiber optic sensor to sense acoustic signals.

5. The system of claim 4, wherein the fiber optic sensor comprises fiber Bragg grating.

6. The system of claim 2, wherein acoustic signals are received on both the fiber-based sensor system and on a piezo-electric acoustic transducer receiver, and wherein both received signals are transmitted using at least one of a fiber optics system, a radio frequency system, and an acoustic system to transmit a received signal to a communications node.

7. The method of claim 2, further comprising sending an acoustic signal from at least one acoustic telemetry node at a frequency in or below the ultrasound frequency band and recording the acoustic signal sent using the fiber-based sensor system.

8. The system of claim 1, wherein the plurality of electro-acoustic communications nodes are configured to transmit acoustic waves, radio waves, low frequency electromagnetic waves, inductive electromagnetic waves, light, or combinations thereof.

9. The system of claim 8, wherein the at least one sensor communications node is configured to transmit acoustic waves, radio waves, low frequency electromagnetic waves, inductive electromagnetic waves, light, or combinations thereof.

10. The system of claim 9, wherein the at least one sensor communications node are configured to transmit acoustic waves, providing real-time information to the topside data acquisition system.

11. The system of claim 10, wherein each of the plurality of electro-acoustic communications nodes comprises at least one electro-acoustic transducer.

12. The system of claim 1, wherein the at least one sensor communications node comprises: a sealed housing; a power source residing within the housing; and at least one electro-acoustic transducer.

13. The system of claim 12, wherein the at least one sensor communications node further comprises a transceiver or a separate transmitter and receiver associated with the at least one electro-acoustic transducer that is structured and arranged to communicate with the at least one sensor and transmit acoustic waves in response thereto.

14. The system of claim 13, wherein the acoustic waves represent asynchronous packets of information comprising a plurality of separate tones, with at least some of the acoustic waves being indicative of one or more reservoir formation parameters indicative of at least one reservoir formation property.

15. The system of claim 1, wherein the at least one sensor comprises one or more sensors selected from a fluid density sensor, a fluid resistivity sensor, a fluid velocity sensor, a pressure drop sensor, a scintillation detector, a temperature sensor, a vibration sensor; a pressure sensor; a microphone; an ultrasound sensor; a Doppler shift sensor; a chemical sensor; an imaging device; an impedance sensor; an attenuation sensor;

and combinations thereof.

16. The system of claim 1, wherein the at least one sensor comprises a plurality of sensors.

17. The system of claim 1, wherein the at least one sensor employs passive acoustic monitoring, active acoustic measurements, electromagnetic signature detection, sonar monitoring, radar monitoring, or radiation monitoring.

18. The system of claim 1, wherein permeability is determined using a model employing pressure, vibration, and temperature measurements.

19. The system of claim 1, wherein the at least one reservoir formation property is permeability and/or porosity.

20. The system of claim 1, wherein the one or more reservoir formation parameters are pressure, vibration, and temperature which are used to determine permeability.

21. The system of claim 1, wherein data transmitted topside is utilized by the topside data acquisition system for reservoir formation characterization and production optimization.

22. The system of claim 1, wherein the piezoelectric receiver also functions as a power receiver to convert sound and vibration energy into electrical power via an energy harvesting electronics.

23. The system of claim 22, wherein the energy harvesting electronics includes a super-capacitor or chargeable batteries.

24. The system of claim 1, wherein a single voltage is applied equally to each piezoelectric disk.

25. The system of claim 1, wherein the mechanical output of the piezoelectric transmitter is increased by increasing the number of disks while applying the same voltage.

26. The system of claim 1, wherein the piezoelectric receiver comprises a single piezoelectric disk, the single piezoelectric disk having a thickness equivalent to the total thickness of the multiple piezoelectric disks.

27. The system of claim 1, wherein the housing has a first end and a second end, each of which have a clamp associated therewith for clamping to an outer surface of the tubular body.

28. A method for reservoir formation characterization of a well, comprising:

sensing one or more reservoir formation parameters indicative of at least one reservoir formation property via one or more sensors positioned along a tubular body;

receiving signals from the one or more sensors with at least one sensor communications node;

transmitting those signals via a transmitter or transceiver to one of a plurality of electro-acoustic communications nodes attached to a wall of the tubular body;

transmitting signals received by the one of the plurality of electro-acoustic communications nodes to at least one other of the plurality of electro-acoustic communications nodes via a transmitter or transceiver;

transmitting signals received by the at least one other of the plurality of electro-acoustic communications nodes to a topside communications node via a transmitter or transceiver;

determining at least one reservoir formation property from the signals received from the topside communications node; and updating a reservoir formation model in response to the determined at least one reservoir formation property;

wherein each of the plurality of electro-acoustic communication nodes comprises a housing having a mounting face for mounting to a surface of the tubular body, a piezoelectric receiver positioned within the housing, the piezoelectric receiver structured and arranged to receive acoustic waves that propagate through the tubular body, a piezoelectric transmitter positioned within the housing, the piezoelectric transmitter structured and arranged to transmit acoustic waves through the tubular body, and a power source comprising one or more batteries positioned within the housing;

wherein each of the plurality of electro-acoustic communications nodes are configured to transmit signals received from the at least one sensor communications node to the topside communications node in a substantially node-to-node arrangement; and wherein at least one of the piezoelectric transmitter and the piezoelectric receiver comprises multiple piezoelectric disks, each piezoelectric disk having at least a pair of electrodes connected in series with an adjacent piezoelectric disk.

29. The method of claim 28, wherein the well is a production well.

30. The method of claim 29, further comprising optimizing production performance based on the updated reservoir formation model.

31. The method of claim 28, wherein the plurality of electro-acoustic communications nodes are configured to transmit acoustic waves, radio waves, low frequency electromagnetic waves, inductive electromagnetic waves, light, or combinations thereof.

32. The method of claim 28, wherein the at least one sensor communications node is configured to transmit acoustic waves, radio waves, low frequency electromagnetic waves, inductive electromagnetic waves, light, or combinations thereof.

33. The method of claim 32, wherein the plurality of electro-acoustic communications nodes and the at least one sensor communications node are configured to transmit acoustic waves, providing real-time information to the reservoir formation model.

34. The method of claim 33, wherein each of the plurality of electro-acoustic communications nodes comprises at least one electro-acoustic transducer.

35. The method of claim 28, wherein the at least one sensor communications node comprises: a sealed housing; a power source residing within the housing; and at least one electro-acoustic transducer.

36. The method of claim 35, wherein the at least one sensor communications node further comprises a transceiver or a separate transmitter and receiver associated with the at least one electro-acoustic transducer that is structured and arranged to communicate with the at least one sensor and transmit acoustic waves in response thereto.

37. The method of claim 28, wherein the acoustic waves represent asynchronous packets of information comprising a plurality of separate tones, with at least some of the acoustic waves being indicative of one or more reservoir formation parameters indicative of at least one reservoir formation property.

38. The method of claim 28, wherein the one or more sensors are selected from a fluid density sensor, a fluid resistivity sensor, a fluid velocity sensor, a pressure drop sensor, a scintillation detector, a temperature sensor, a vibration sensor; a pressure sensor; a microphone; an ultrasound sensor; a Doppler shift sensor; a chemical sensor; an imaging device; an impedance sensor; an attenuation sensor; and combinations thereof.

39. The method of claim 28, further comprising: sending an acoustic signal from one of the plurality of electro-acoustic communications nodes; and determining from the acoustic response a physical parameter of the reservoir formation.

40. The method of claim 39, further comprising repeating the steps of claim 39 at a different time, and measuring the change in acoustic response to determine whether a physical change in one or more reservoir formation properties has occurred.

41. The method of claim 28, wherein sensing one or more reservoir formation parameters further comprises using a fiber-based sensor system as one of the at least one sensor communication nodes to receive acoustic signals.

42. The method of claim 41, wherein the fiber-based sensor comprises a fiber optic sensor to sense acoustic signals.

43. The method of claim 42, wherein the fiber optic sensor comprises fiber Bragg grating.

44. The method of claim 41, wherein at least one of the transmitter or the transceiver, and the at least one of the plurality of electro-acoustic communications nodes further comprises the fiber-based sensor system to transmit sensed signals.

45. The method of claim 44, wherein the fiber-based sensor system further comprises using at least one of a fiber optic system, a radio frequency system, and an acoustic system to transmit a received signal to Hall one of the plurality of electro-acoustic communications nodes.

46. The method of claim 41, further comprising receiving acoustic signals on both the fiber-based sensor system and on a piezo-electric acoustic transducer receiver and transmitting both received signals using at least one of a fiber optic system, a radio frequency system, and an acoustic system to transmit an received signal to a communications node.

47. The method of claim 41, further comprising sending an acoustic signal from at least one acoustic telemetry node at a frequency in or below the ultrasound frequency band and recording the acoustic signal sent using the fiber-based sensor system.

48. The system of claim 3, wherein the fiber-based sensor system uses at least one of fiber optics, radio frequency, and an acoustic signal to transmit a received signal to one of the plurality of electro-acoustic communications nodes.

* * * * *